US011953252B2

(12) United States Patent
Kim et al.

(10) Patent No.: US 11,953,252 B2
(45) Date of Patent: Apr. 9, 2024

(54) ICE MAKER AND METHOD FOR CONTROLLING ICE MAKER

(71) Applicant: LG ELECTRONICS INC., Seoul (KR)

(72) Inventors: Yonghyun Kim, Seoul (KR); Jinil Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/119,424

(22) Filed: Mar. 9, 2023

(65) Prior Publication Data

US 2023/0213258 A1 Jul. 6, 2023

Related U.S. Application Data

(63) Continuation of application No. 17/984,775, filed on Nov. 10, 2022, which is a continuation of application (Continued)

(30) Foreign Application Priority Data

Nov. 19, 2018 (KR) ..... 10-2018-0142446

(51) Int. Cl.
*F25C 5/08* (2006.01)
*F25C 1/04* (2018.01)

(52) U.S. Cl.
CPC ..... *F25C 5/08* (2013.01); *F25C 1/04* (2013.01); *F25C 2400/14* (2013.01); *F25C 2600/04* (2013.01); *F25C 2700/12* (2013.01)

(58) Field of Classification Search
CPC ..... F25C 5/08; F25C 1/04; F25C 2700/12; F25C 2600/04; F25C 1/18; F25C 1/24; F25C 1/243; F25D 23/12

(Continued)

(56) References Cited

U.S. PATENT DOCUMENTS 3,775,992 A 12/1973 Bright
6,357,720 B1 3/2002 Shapiro et al.

(Continued)

FOREIGN PATENT DOCUMENTS

CN 1461928 12/2003
CN 1532484 A 9/2004

(Continued)

OTHER PUBLICATIONS

Office Action in Brazilian Appln. No. 112021009581-0, dated Jul. 9, 2023, 7 pages.

(Continued)

*Primary Examiner* — Steve S Tanenbaum
(74) *Attorney, Agent, or Firm* — Fish & Richardson P.C.

(57) ABSTRACT

An ice maker includes: an upper tray defining an upper chamber that is a portion of an ice chamber, where an upper opening is provided in an upper side of the upper tray; a lower tray defining a lower chamber that is another portion of the ice chamber; a lower support supporting the lower tray and provided with a lower heater; and a control unit configured to operate the lower heater in an ice making process. The control unit variably controls an output of the lower heater so that bubbles included in water in the ice chamber are gathered in a lowermost section in the ice making process.

20 Claims, 34 Drawing Sheets

Related U.S. Application Data

No. 16/685,837, filed on Nov. 15, 2019, now Pat. No. 11,519,649.

(58) Field of Classification Search
USPC ..... 62/73
See application file for complete search history.

(56) References Cited

U.S. PATENT DOCUMENTS

| | | | | |
|---|---|---|---|---|
| 6,935,124 | B2 * | 8/2005 | Takahashi | F25C 1/18 62/347 |
| 8,371,133 | B2 * | 2/2013 | Kim | F25C 1/18 62/352 |
| 9,696,079 | B2 | 7/2017 | Boarman et al. | |
| RE49,341 | E | 12/2022 | Lee et al. | |
| 2010/0018226 | A1 | 1/2010 | Kim et al. | |
| 2010/0205996 | A1 | 8/2010 | Ducharme | |
| 2013/0014536 | A1 * | 1/2013 | Son | F25C 1/25 62/340 |
| 2014/0165599 | A1 | 6/2014 | Boarman et al. | |
| 2014/0182325 | A1 | 7/2014 | Lee et al. | |
| 2015/0107275 | A1 | 4/2015 | Papalia | |
| 2016/0138844 | A1 | 5/2016 | Boarman et al. | |
| 2017/0211865 | A1 | 7/2017 | Lee et al. | |
| 2018/0231294 | A1 | 8/2018 | Song et al. | |

FOREIGN PATENT DOCUMENTS

| | | | | |
|---|---|---|---|---|
| CN | 101573571 | A | | 11/2009 |
| CN | 102549359 | A | | 7/2012 |
| CN | 102549360 | | | 7/2012 |
| CN | 102878743 | | | 1/2013 |
| CN | 105387667 | | | 3/2016 |
| CN | 106949684 | | | 7/2017 |
| JP | H01230968 | | | 9/1989 |
| JP | 05203299 | | | 8/1993 |
| JP | 05203299 | A | * | 8/1993 |
| JP | H05203299 | | | 8/1993 |
| JP | H06241626 | A | | 9/1994 |
| JP | H06323704 | A | | 11/1994 |
| JP | H0979717 | | | 3/1997 |
| JP | H0979718 | | | 3/1997 |
| JP | H09269172 | A | | 10/1997 |
| JP | H10185377 | | | 7/1998 |
| JP | H10253212 | | | 9/1998 |
| JP | 2001041621 | | | 2/2001 |
| JP | 2001355945 | A | | 12/2001 |
| JP | 2003056956 | | | 2/2003 |
| JP | 2003075035 | A | | 3/2003 |
| JP | 2003114072 | | | 4/2003 |
| JP | 2003232587 | | | 8/2003 |
| JP | 2003336947 | A | | 11/2003 |
| JP | 2004309046 | A | | 11/2004 |
| JP | 2010101560 | | | 5/2010 |
| JP | 2012255579 | | | 12/2012 |
| KR | 19970047506 | A | | 1/1999 |
| KR | 19990013142 | A | | 2/1999 |
| KR | 20060108103 | A | | 10/2006 |
| KR | 100833860 | | | 6/2008 |
| KR | 20100056293 | A | | 5/2010 |
| KR | 101208550 | | | 12/2012 |
| KR | 20130009332 | | | 1/2013 |
| KR | 20130036421 | A | | 4/2013 |
| KR | 20140088321 | | | 7/2014 |
| KR | 101850918 | | | 5/2015 |
| SU | 1753213 | | | 8/1992 |

OTHER PUBLICATIONS

Office Action in Chinese Appln. No. 202210931354.2, dated May 13, 2023, 20 pages (with English translation).
Office Action in Chinese Appln. No. 202210931387.7, dated May 13, 2023, 20 pages (with English translation).
Office Action in Korean Appln. No. 1020230008140, dated Jun. 10, 2023, 10 pages (with English translation).
Extended European Search Report in European Application No. 19209306.0, dated Mar. 27, 2020, 8 pages.
International Search Report in International Application No. PCT/KR2019/015484, dated Feb. 25, 2020, 12 pages.
Office Action in Chinese Appln. No. 201911119388, dated Mar. 2, 2021, 16 pages (with English translation).
Office Action in Korean Application No. 10-2023-0008140, dated Feb. 13, 2023, 13 pages (with English Translation).
Office Action in Russian Appln. No. 2021117721, dated Nov. 16, 2021, 14 pages (with English translation).
Office Action in Korean Appln. No. 1020180142446, mailed on Sep. 20, 2023, 8 pages (with English translation).
Office Action in Chinese Appln. No. 202210931387.7, mailed on Jan. 30, 2024, 18 pages (with English translation).

* cited by examiner

ICE MAKER AND METHOD FOR CONTROLLING ICE MAKER

CROSS-REFERENCE TO RELATED APPLICATIONS

This application is a continuation of U.S. application Ser. No. 17/984,775, filed on Nov. 10, 2022, which is a continuation of U.S. application Ser. No. 16/685,837, filed on Nov. 15, 2019 (now U.S. Pat. No. 11,519,649), which claims the benefit of priority to Korean Application No. 10-2018-0142446, filed on Nov. 19, 2018. The disclosures of the prior applications are incorporated by reference in their entirety.

BACKGROUND

The present disclosure relates to an ice maker and a method for controlling an ice maker.

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is configured so that water supplied from a water supply source or a water tank is accommodated in a tray to make ice.

Also, the ice maker is configured to transfer the made ice from the ice tray in a heating manner or twisting manner.

As described above, the ice maker through which water is automatically supplied, and the ice automatically transferred may be opened upward so that the mode ice is pumped up.

As described above, the ice made in the ice maker may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

An ice maker is disclosed in Korean Patent Registration No. 10-1850918 that is a prior art document.

The ice maker disclosed in the prior art document includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document, although the spherical ice is made by the hemispherical upper cell and the hemispherical lower cell, since the ice is made at the same time in the upper and lower cells, bubbles containing water are not completely discharged but are dispersed in the water to make opaque ice.

SUMMARY

Embodiments provide an ice maker and a refrigerator that is capable of making transparent ice.

Embodiments also provide an ice maker and a refrigerator that is capable of making ice having uniform transparency for each height of the ice.

Embodiments also provide an ice maker and a refrigerator that is capable of making ice having uniform transparency for each made ice.

An ice maker according to one aspect comprises: an upper tray defining an upper chamber that is a portion of an ice chamber, wherein an upper opening is provided in an upper side of the upper tray; a lower tray defining a lower chamber that is another portion of the ice chamber; a lower support configured to support the lower tray and on which a lower heater is mounted; and a control unit configured to operate the lower heater in an ice making process, wherein the control unit variably controls an output of the lower heater so that bubbles included in water in the ice chamber are gathered in a lowermost section in the ice making process.

A refrigerator according to another aspect comprises: a storage space in which foods are stored; and an ice maker for generating ice by cold air provided to the storage space, wherein the ice maker comprises: an upper tray defining an upper chamber that is a portion of an ice chamber, wherein an upper opening is provided in an upper side of the upper tray; a lower tray defining a lower chamber that is another portion of the ice chamber; a lower support supporting the lower tray and provided with a lower heater; and a control unit configure to operate the lower heater in an ice making process, wherein the control unit variably controls an output of the lower heater so that bubbles included in water in the ice chamber are gathered in the lowermost section in the ice making process.

DETAILED DESCRIPTION OF THE EMBODIMENTS

Figure 1:
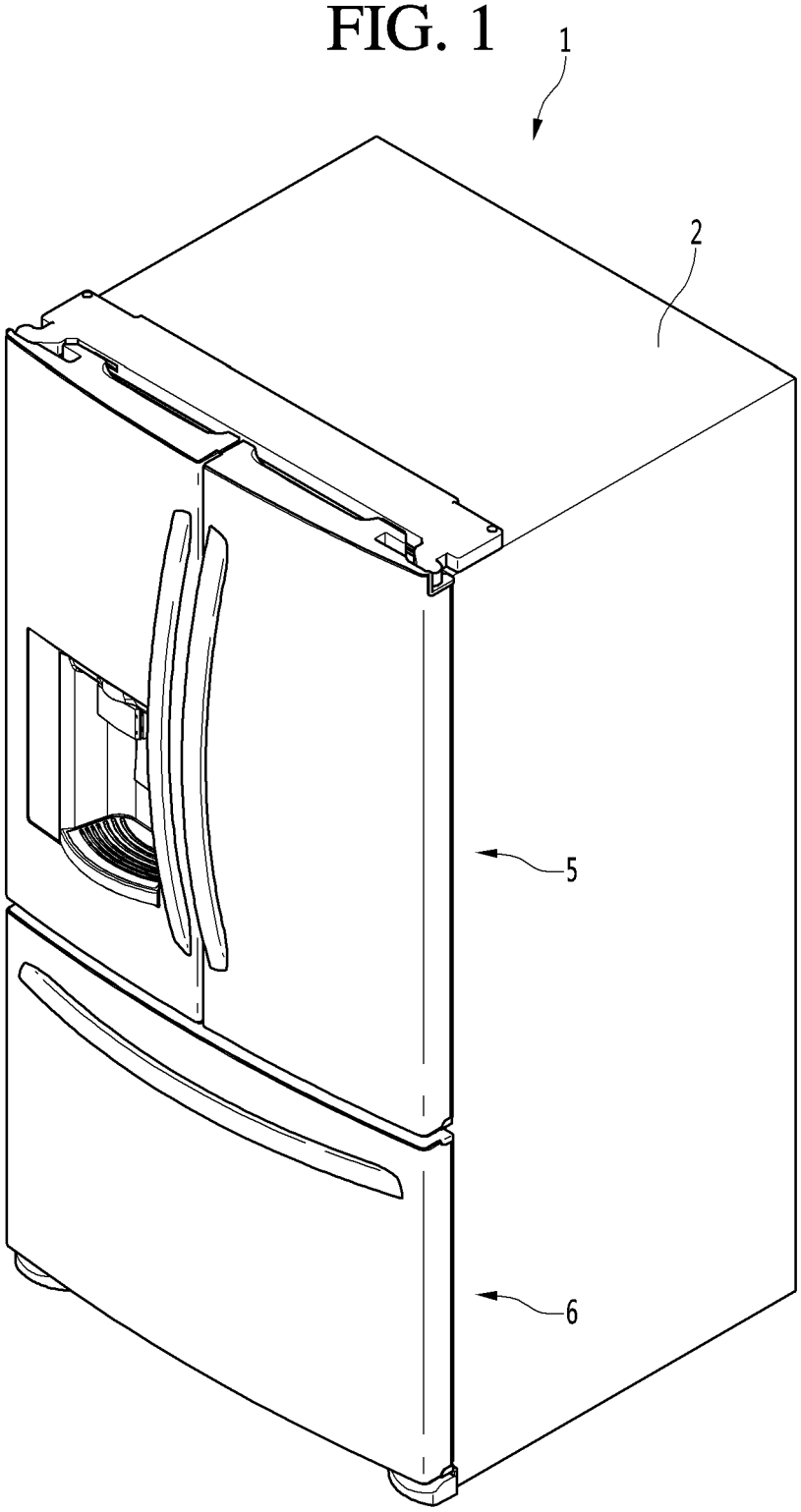
FIG. 1 is a perspective view of a refrigerator according to an embodiment.
Figure 2:
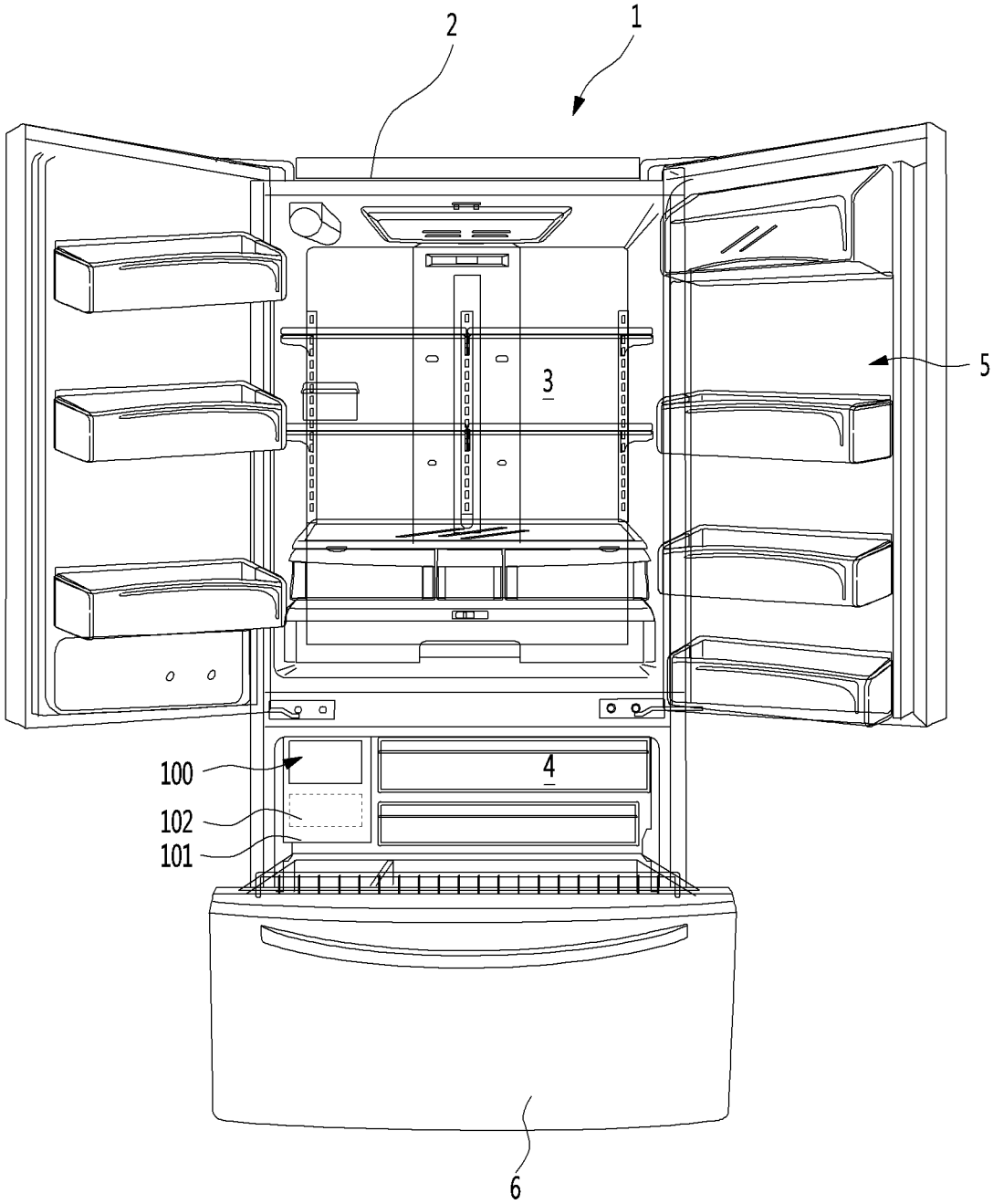
FIG. 2 is a view illustrating a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is configured to make ice by using supplied water. Here, the ice may have a spherical shape. Alternatively, the ice maker 100 may be provided in the freezing compartment door 6, the refrigerating compartment 3, or the freezing compartment door 5.

Also, an ice bin 102 in which the made ice is stored after being transferred from the ice maker 100 may be further provided below the ice maker 100.

The ice maker 100 and the ice bin 102 may be mounted in the freezing compartment 4 in a state of being respectively mounted in separate housings 101.

A user may open the refrigerating compartment door 6 to approach the ice bin 102, thereby obtaining the ice.

In another example, a dispenser 7 for dispensing purified water or the made ice to the outside may be provided in the refrigerating compartment door 5.

Also, the ice made in the ice maker 100 or the ice stored in the ice bin 102 after being made in the ice maker 100 may be transferred to the dispenser 7 by a transfer unit. Thus, the user may obtain the ice from the dispenser 7.

Hereinafter, the ice maker will be described in detail with reference to the accompanying drawings.

Figure 3A:
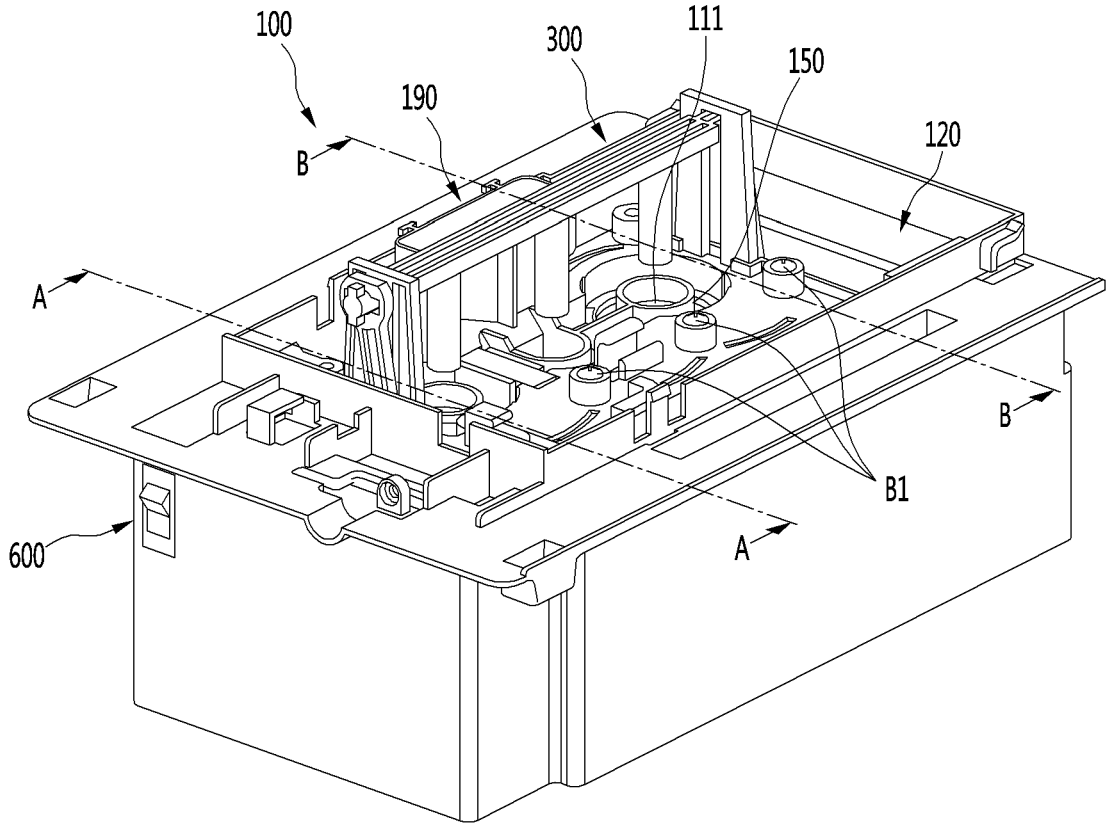
FIGS. 3A and 3B are perspective views of an ice maker according to an embodiment.
Figure 3B:
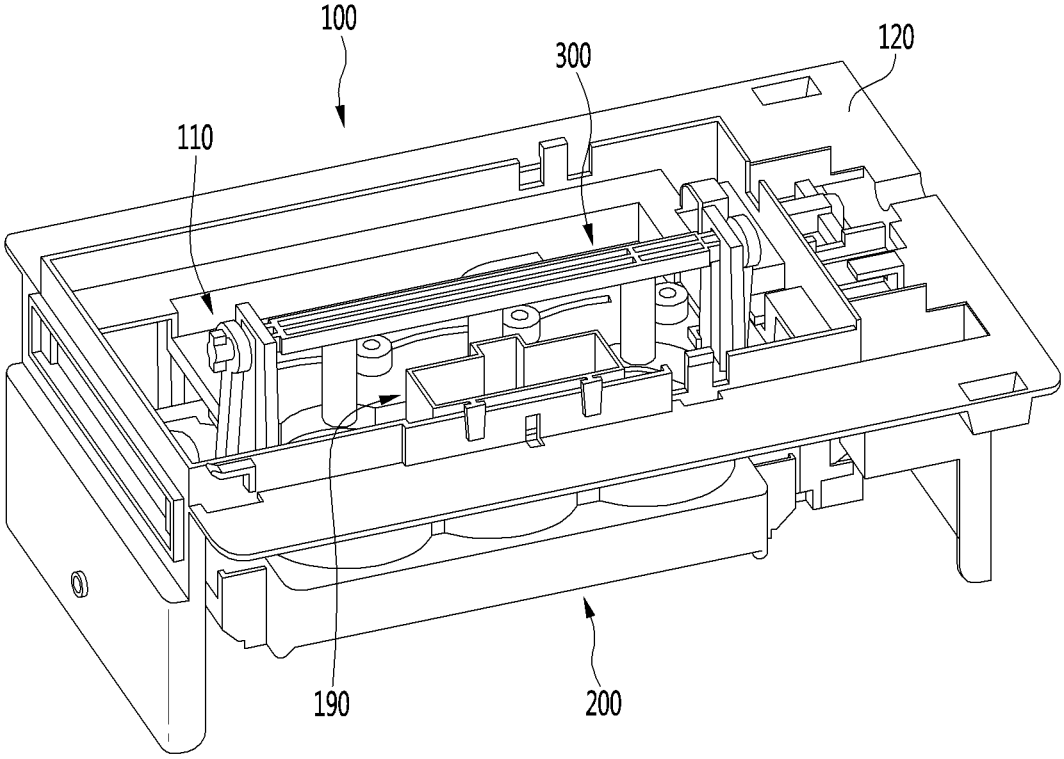
Figure 4:
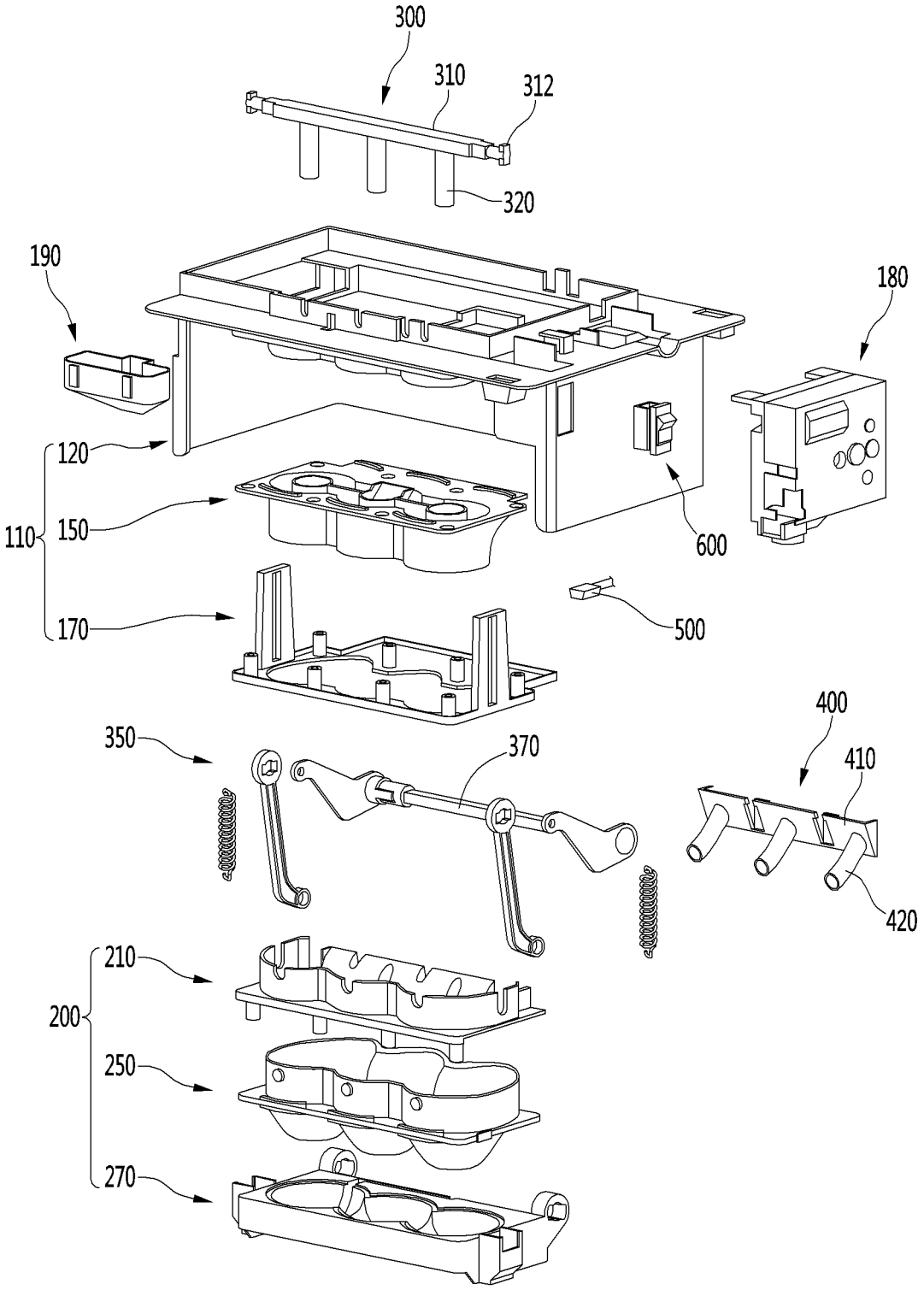
FIG. 4 is an exploded perspective view of the ice maker according to an embodiment.

FIGS. 3A and 3B are perspective views of the ice maker according to an embodiment, and FIG. 4 is an exploded perspective view of the ice maker according to an embodiment.

Referring to FIGS. 3A to 4, the ice maker 100 may include an upper assembly 110 and a lower assembly 200.

The lower assembly 200 may rotate with respect to the upper assembly 110. For example, the lower assembly 200 may be connected to be rotatable with respect to the upper assembly 110.

In a state in which the lower assembly 200 contacts the upper assembly 110, the lower assembly 200 together with the upper assembly 110 may make spherical ice.

That is, the upper assembly 110 and the lower assembly 200 may define an ice chamber 111 for making the spherical ice. The ice chamber 111 may have a chamber having a substantially spherical shape. The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110. The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110. The upper ejector 300 may be configured so that the ice closely attached to the upper assembly 110 is separated from the upper assembly 110.

The upper ejector 300 may include an ejector body 310 and a plurality of upper ejecting pins 320 extending in a direction crossing the ejector body 310. The upper ejecting pins 320 may be provided in the same number of ice chambers 111.

A separation prevention protrusion 312 for preventing a connection unit 350 from being separated in the state of being coupled to the connection unit 350 that will be described later may be provided on each of both ends of the ejector body 310. For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed. The ice pressed by the upper ejecting pin 320 may be separated from the upper assembly 110.

The ice maker 100 may further include a lower ejector 400 so that the ice closely attached to the lower assembly 200 is capable of being separated. The lower ejector 400 may press the lower assembly 200 to separate the ice closely attached to the lower assembly 200 from the lower assembly 200. For example, the lower ejector 400 may be fixed to the upper assembly 110.

The lower ejector 400 may include an ejector body 410 and a plurality of lower ejecting pins 420 protruding from the ejector body 410. The lower ejecting pins 420 may be provided in the same number of ice chambers 111. While the lower assembly 200 rotates to transfer the ice, rotation force of the lower assembly 200 may be transmitted to the upper ejector 300.

For this, the ice maker 100 may further include the connection unit 350 connecting the lower assembly 200 to the upper ejector 300. The connection unit 350 may include one or more links. For example, when the lower assembly 200 rotates in one direction, the upper ejector 300 may descend by the connection unit 350 to allow the upper ejector pin 320 to press the ice. On the other hand, when the lower assembly 200 rotates in the other direction, the upper ejector 300 may ascend by the connection unit 350 to return to its original position.

Hereinafter, the upper assembly 110 and the lower assembly 200 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper case 120 fixing a position of the upper tray 150 and an upper support 170.

The upper tray 150 may be disposed below the upper case 120. A portion of the upper support 170 may be disposed below the upper tray 150.

As described above, the upper case 120, the upper tray 150, and the upper support 170, which are vertically aligned, may be coupled to each other through a coupling member. That is, the upper tray 150 may be fixed to the upper case 120 through coupling of the coupling member. Also, the upper support 170 may restrict downward movement of the upper tray 150.

For example, the water supply part 190 may be fixed to the upper case 120.

The ice maker 100 may further include a temperature sensor 500 detecting a temperature of the upper tray 150. For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111.

The lower assembly 200 may further include a lower support 270 supporting a lower portion of the lower tray 250 and a lower case 210 of which at least a portion covers an upper side of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice. That is, when the switch 600 is turned on, water may be supplied to the ice maker 100. Then, an ice making process of making ice by using cold air and an ice separating process of transferring the ice through the rotation of the lower assembly 200.

On the other hand, when the switch 600 is manipulated to be turned off, the making of the ice through the ice maker 100 may be impossible. For example, the switch 600 may be provided in the upper case 120.

<Upper Case>

Figure 5:
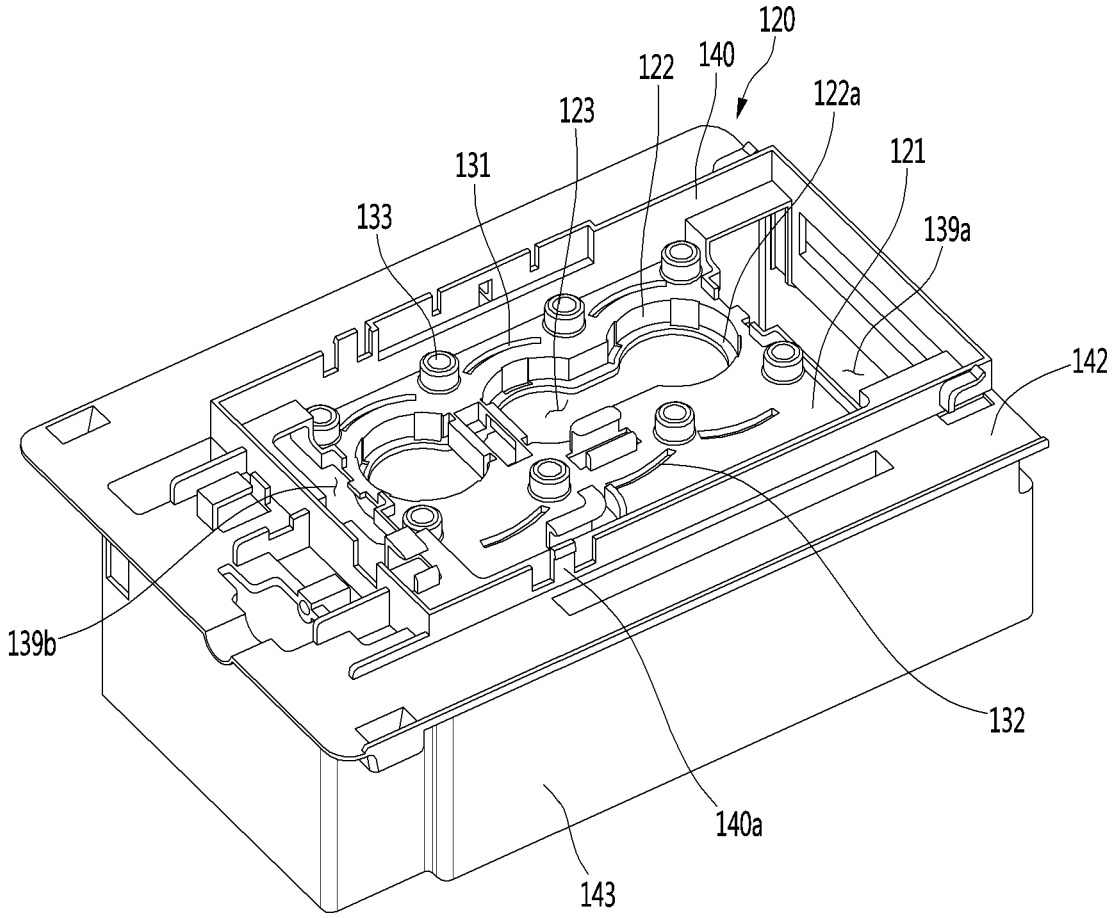
FIG. 5 is a top perspective view of an upper case according to an embodiment.
Figure 6:
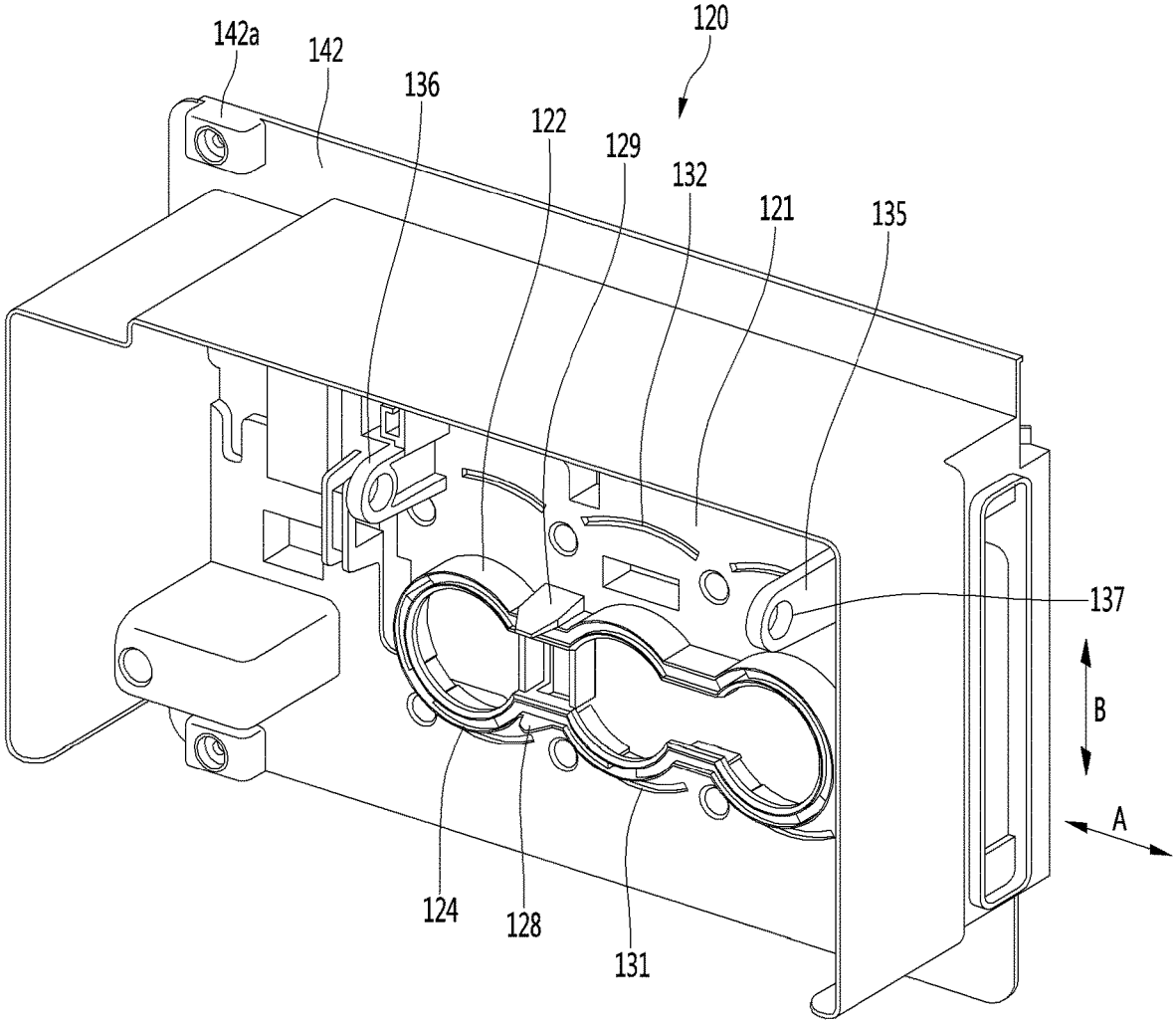
FIG. 6 is a bottom perspective view of the upper case according to an embodiment.

FIG. 5 is a top perspective view of the upper case according to an embodiment, and FIG. 6 is a bottom perspective view of the upper case according to an embodiment.

Referring to FIGS. 5 and 6, the upper case 120 may be fixed to a housing 101 within the freezing compartment 4 in a state in which the upper tray 150 is fixed.

The upper case 120 may include an upper plate for fixing the upper tray 150. The upper tray 150 may be fixed to the upper plate 121 in a state in which a portion of the upper tray 150 contacts a bottom surface of the upper plate 121.

An opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123. The upper plate 121 may include a recess part 122 that is recessed downward. The opening 123 may be defined in a bottom surface 122*a* of the recess part 122. Thus, the upper tray 150 passing through the opening 123 may be disposed in a space defined by the recess part 122.

A heater coupling part 124 for coupling an upper heater (see reference numeral 148 of FIG. 13) that heats the upper tray 150 so as to transfer the ice may be provided in the upper case 120. For example, the heater coupling part 124 may be provided on the upper plate 121. The heater coupling part 124 may be disposed below the recess part 122.

The upper case 120 may further include a plurality of installation ribs 128 and 129 for installing the temperature sensor 500. The pair of installation ribs 128 and 129 may be disposed to be spaced apart from each other in a direction of an arrow B of FIG. 6. The pair of installation ribs 128 and 129 may be disposed to face each other, and the temperature sensor 500 may be disposed between the pair of installation ribs 128 and 129.

The pair of installation ribs 128 and 129 may be provided on the upper plate 121.

A plurality of slots 131 and 132 coupled to the upper tray 150 may be provided in the upper plate 121. A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123. The opening 123 may be defined between the first upper slot 131 and the second upper slot 132.

The first upper slot 131 and the second upper slot 132 may be spaced apart from each other in a direction of an arrow B of FIG. 6.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of the arrow A.

In this specification, the direction of the arrow A may be the same direction as the arranged direction of the plurality of ice chambers 111.

For example, the first upper slot 131 may be defined in a curved shape. Thus, the first upper slot 131 may increase in length. For example, the second upper slot 132 may be defined in a curved shape. Thus, the second upper slot 132 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the opening 123 may be different from that between the second upper slot 132 and the opening 123. For example, the distance between the first upper slot 131 and the opening 123 may be greater than that between the second upper slot 132 and the opening 123.

Also, when viewed from the opening 123 toward each of the upper slots 131, a shape that is convexly rounded from each of the slots 131 toward the outside of the opening 123 may be provided.

The upper plate 121 may further include a sleeve 133 into which a coupling boss of the upper support, which will be described later, is inserted. The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B. A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may further include a plurality of hinge supports 135 and 136 allowing the lower assembly 200 to rotate. The plurality of hinge supports 135 and 136 may be disposed to be spaced apart from each other in the direction of the arrow A with respect to FIG. 6. Also, a first hinge hole 137 may be defined in each of the hinge supports 135 and 136. For example, the plurality of hinge supports 135 and 136 may extend downward from the upper plate 121.

The upper case 120 may further include a vertical extension part 140 vertically extending along a circumference of the upper plate 121. The vertical extension part 140 may extend upward from the upper plate 121.

The vertical extension part 140 may include one or more coupling hooks 140*a*. The upper case 120 may be hook-coupled to the housing 101 by the coupling hooks 140*a*. The water supply part 190 may be coupled to the vertical extension part 140.

The upper case 120 may further include a horizontal extension part 142 horizontally extending to the outside of the vertical extension part 140.

A screw coupling part 142*a* protruding outward to screw-couple the upper case 120 to the housing 101 may be provided on the horizontal extension part 142.

The upper case 120 may further include a side circumferential part 143. The side circumferential part 143 may extend downward from the horizontal extension part 142.

The side circumferential part 143 may be disposed to surround a circumference of the lower assembly 200. That is, the side circumferential part 143 may prevent the lower assembly 200 from being exposed to the outside.

Although the upper case is coupled to the separate housing 101 within the freezing compartment 4 as described above, the embodiment is not limited thereto. For example, the upper case 120 may be directly coupled to a wall defining the freezing compartment 4.

<Upper Tray>

Figure 7:
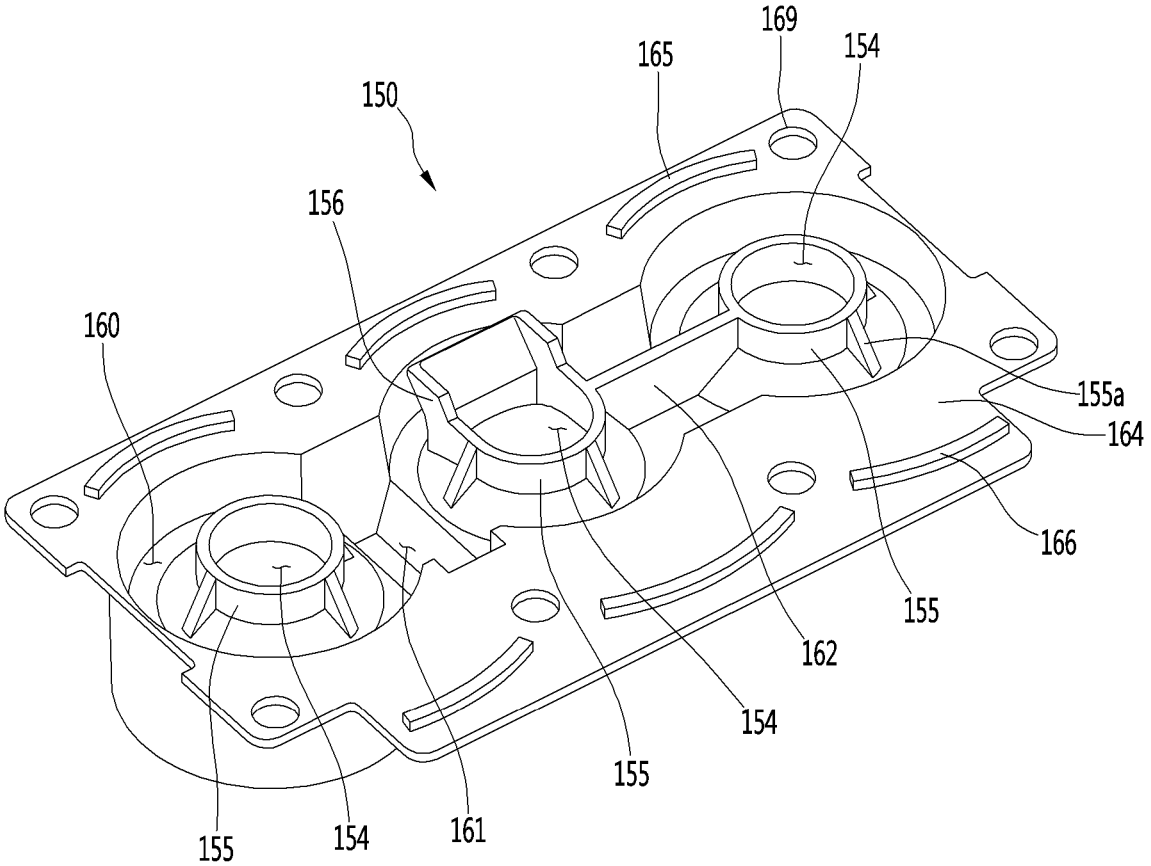
FIG. 7 is a top perspective view of an upper tray according to an embodiment.
Figure 8:
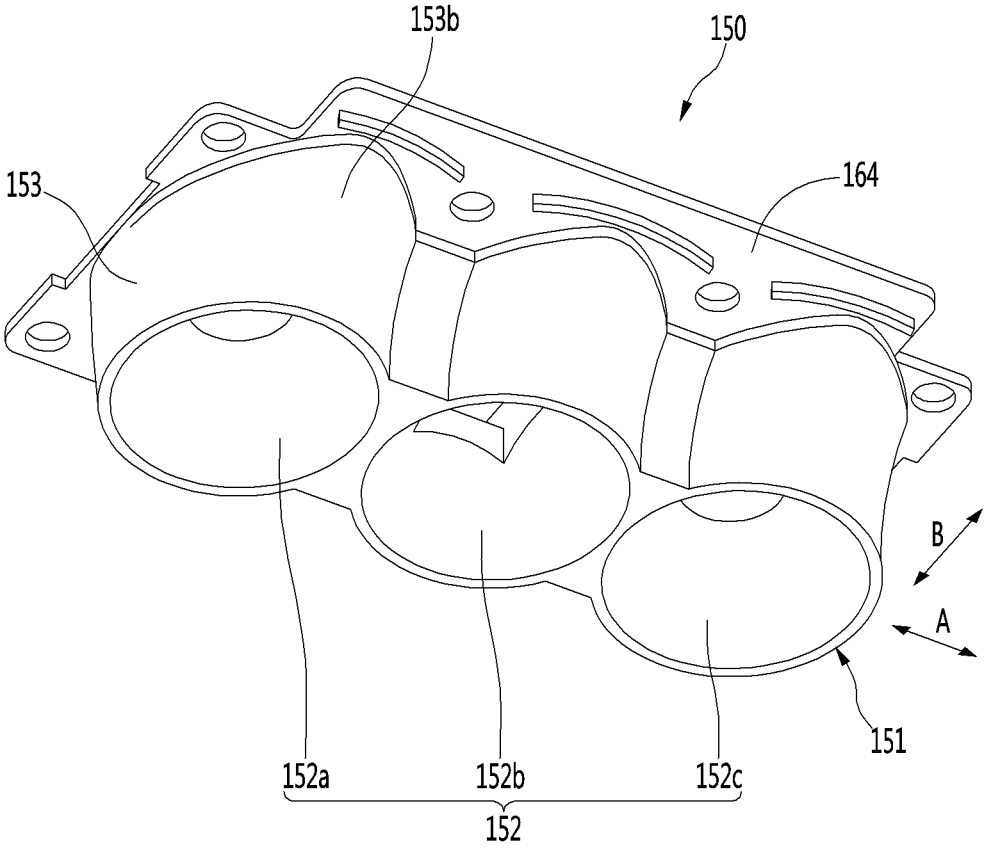
FIG. 8 is a bottom perspective view of the upper tray according to an embodiment.
Figure 9:
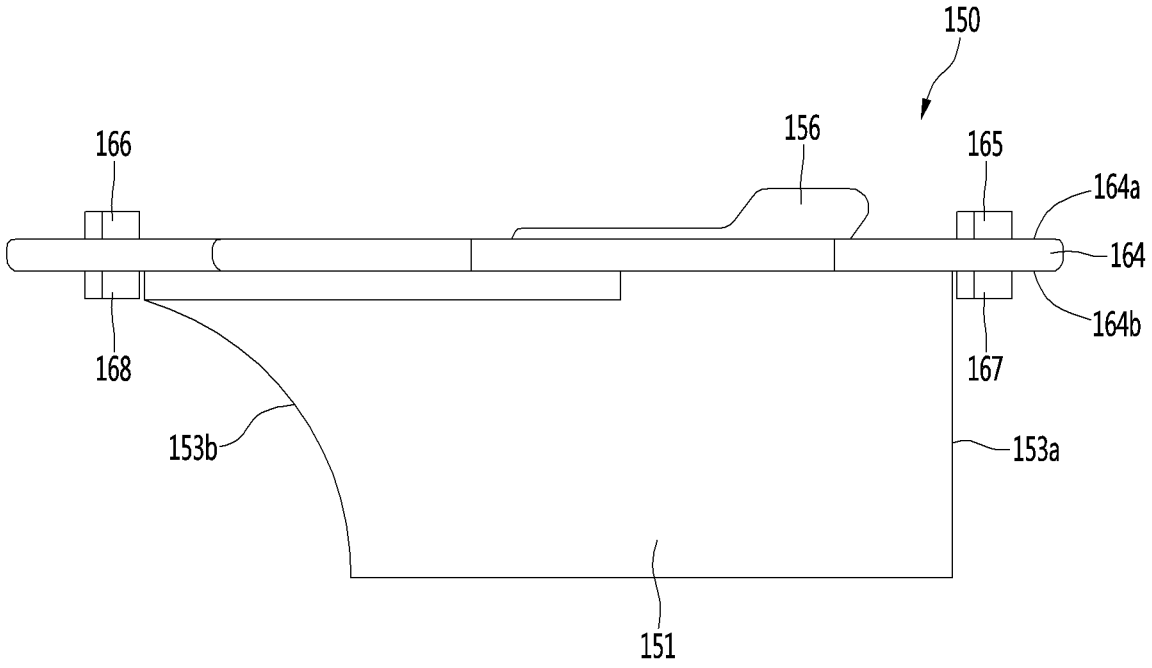
FIG. 9 is a side view of the upper tray according to an embodiment.

FIG. 7 is a top perspective view of the upper tray according to an embodiment, FIG. 8 is a bottom perspective view of the upper tray according to an embodiment, and FIG. 9 is a side view of the upper tray according to an embodiment.

Referring to FIGS. 7 to 9, the upper tray 150 may be made of a non-metallic member and a flexible material that is capable of being restored to its original shape after being deformed by an external force.

For example, the upper tray 150 may be made of a silicone material. Like this embodiment, when the upper tray 150 is made of the silicone material, even though external force is applied to deform the upper tray 150 during the ice separating process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. That is, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicone material, the upper tray 150 may be prevented from being melted or thermally deformed by heat provided from an upper heater that will be described later.

The upper tray 150 may include an upper tray body 151 defining an upper chamber 152 that is a portion of the ice chamber 111.

The upper tray body 151 may be define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG. 8. The direction of the arrow A of FIG. 8 may be the same direction as the direction of the arrow A of FIG. 6.

The upper chamber 152 may have a hemispherical shape. That is, an upper portion of the spherical ice may be made by the upper chamber 152.

An upper opening 154 through which water is introduced into the upper chamber may be defined in an upper side of the upper tray body 151. For example, three upper openings 154 may be defined in the upper tray body 151. Cold air may be guided into the ice chamber 111 through the upper opening 154.

In the ice separating process, the upper ejector 300 may be inserted into the upper chamber 152 through the upper opening 154.

While the upper ejector 300 is inserted through the upper opening 154, an inlet wall 155 may be provided on the upper tray 150 to minimize deformation of the upper opening 154 in the upper tray 150.

The inlet wall 155 may be disposed along a circumference of the upper opening 154 and extend upward from the upper tray body 151.

The inlet wall 155 may have a cylindrical shape. Thus, the upper ejector 30 may pass through the upper opening 154 via an inner space of the inlet wall 155.

One or more first connection ribs 155*a* may be provided along a circumference of the inlet wall 155 to prevent the inlet wall 155 from being deformed while the upper ejector 300 is inserted into the upper opening 154.

The first connection rib 155*a* may connect the inlet wall 155 to the upper tray body 151. For example, the first connection rib 155*a* may be integrated with the circumference of the inlet wall 155 and an outer surface of the upper tray body 151.

Although not limited, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*.

Although not limited, the water supply guide 156 may be provided in the inlet wall corresponding to the second upper chamber 152*b*.

The water supply guide 156 may be inclined upward from the inlet wall 155 in a direction which is away from the second upper chamber 152*b*.

The upper tray 150 may further include a first accommodation part 160. The recess part 122 of the upper case 120 may be accommodated in the first accommodation part 160.

A heater coupling part 124 may be provided in the recess part 122, and an upper heater (see reference numeral 148 of FIG. 13) may be provided in the heater coupling part 124. Thus, it may be understood that the upper heater (see reference numeral 148 of FIG. 13) is accommodated in the first accommodation part 160.

The first accommodation part 160 may be disposed in a shape that surrounds the upper chambers 152*a*, 152*b*, and 152*c*. The first accommodation part 160 may be provided by recessing a top surface of the upper tray body 151 downward.

The heater coupling part 124 to which the upper heater (see reference numeral 148 of FIG. 13) is coupled may be accommodated in the first accommodation part 160.

The upper tray 150 may further include a second accommodation part 161 (or referred to as a sensor accommodation part) in which the temperature sensor 500 is accommodated.

For example, the second accommodation part 161 may be provided in the upper tray body 151. Although not limited, the second accommodation part 161 may be provided by recessing a bottom surface of the first accommodation part 160 downward.

Also, the second accommodation part 161 may be disposed between the two upper chambers adjacent to each other. For example, the second accommodation part 161 may be disposed between the first upper chamber 152*a* and the second upper chamber 152*b*.

Thus, an interference between the upper heater (see reference numeral 148 of FIG. 13) accommodated in the first accommodation part 160 and the temperature sensor 500 may be prevented.

In the state in which the temperature sensor 500 is accommodated in the second accommodation part 161, the temperature sensor 500 may contact an outer surface of the upper tray body 151.

The chamber wall 153 of the upper tray body 151 may include a vertical wall 153*a* and a curved wall 153*b*.

The curved wall 153*b* may be rounded upward in a direction that is away from the upper chamber 152.

The upper tray 150 may further include a horizontal extension part 164 horizontally extending from the circumference of the upper tray body 151. For example, the horizontal extension part 164 may extend along a circumference of an upper edge of the upper tray body 151.

The horizontal extension part 164 may contact the upper case 120 and the upper support 170.

For example, a bottom surface 164*b* (or referred to as a "first surface") of the horizontal extension part 164 may contact the upper support 170, and a top surface 164*a* (or referred to as a "second surface") of the horizontal extension part 164 may contact the upper case 120.

At least a portion of the horizontal extension part 164 may be disposed between the upper case 120 and the upper support 170.

The horizontal extension part 164 may include a plurality of upper protrusions 165 and 166 respectively inserted into the plurality of upper slots 131 and 132.

The plurality of upper protrusions 165 and 166 may include a first upper protrusion 165 and a second upper protrusion 166 disposed at an opposite side of the first upper protrusion 165 with respect to the upper opening 154.

The first upper protrusion 165 may be inserted into the first upper slot 131, and the second upper protrusion 166 may be inserted into the second upper slot 132.

The first upper protrusion 165 and the second upper protrusion 166 may protrude upward from the top surface 164*a* of the horizontal extension part 164.

The first upper protrusion 165 and the second upper protrusion 166 may be spaced apart from each other in the direction of the arrow B of FIG. 8. The direction of the arrow B of FIG. 8 may be the same direction as the direction of the arrow B of FIG. 6.

Although not limited, the plurality of first upper protrusions 165 may be arranged to be spaced apart from each other in the direction of the arrow A.

Also, the plurality of second upper protrusions 166 may be arranged to be spaced apart from each other in the direction of the arrow A.

For example, the first upper protrusion 165 may be provided in a curved shape. Also, for example, the second upper protrusion 166 may be provided in a curved shape.

In this embodiment, each of the upper protrusions 165 and 166 may be configured so that the upper tray 150 and the upper case 120 are coupled to each other, and also, the horizontal extension part is prevented from being deformed during the ice making process or the ice separating process.

Here, when each of the upper protrusions 165 and 166 is provided in the curved shape, distances between the upper protrusions 165 and 166 and the upper chamber 152 in a longitudinal direction of the upper protrusions 165 and 166 may be equal or similar to each other to effectively prevent the horizontal extension parts 264 from being deformed.

For example, the deformation in the horizontal direction of the horizontal extension part 264 may be minimized to prevent the horizontal extension part 264 from being plastic-deformed. If when the horizontal extension part 264 is plastic-deformed, since the upper tray body is not positioned at the correct position during the ice making, the shape of the ice may not close to the spherical shape.

The horizontal extension part 164 may further include a plurality of lower protrusions 167 and 168. The plurality of lower protrusions 167 and 168 may be inserted into a lower slot of the upper support 170, which will be described below.

The plurality of lower protrusions 167 and 168 may include a first lower protrusion 167 and a second lower protrusion 168 disposed at an opposite side of the first lower protrusion 167 with respect to the upper chamber 152.

The first lower protrusion 167 and the second lower protrusion 168 may protrude upward from the bottom surface 164*b* of the horizontal extension part 164.

The first lower protrusion 167 may be disposed at an opposite to the first upper protrusion 165 with respect to the horizontal extension part 164. The second lower protrusion 168 may be disposed at an opposite side of the second upper protrusion 166 with respect to the horizontal extension part 164.

The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Since the protrusions 165, 166, 167, and 168 are disposed on each of the top and bottom surfaces 164*a* and 164*b* of the horizontal extension part 164, the deformation in the horizontal direction of the horizontal extension part 164 may be effectively prevented.

A through-hole 169 through which the coupling boss of the upper support 170, which will be described later, may be provided in the horizontal extension part 164.

For example, a plurality of through-holes 169 may be provided in the horizontal extension part 164.

A portion of the plurality of through-holes 169 may be disposed between the two first upper protrusions 165 adjacent to each other or the two first lower protrusions 167 adjacent to each other.

The other portion of the plurality of through-holes 169 may be disposed between the two second lower protrusions 168 adjacent to each other or be disposed to face a region between the two second lower protrusions 168.

<Upper Support>

Figure 10:
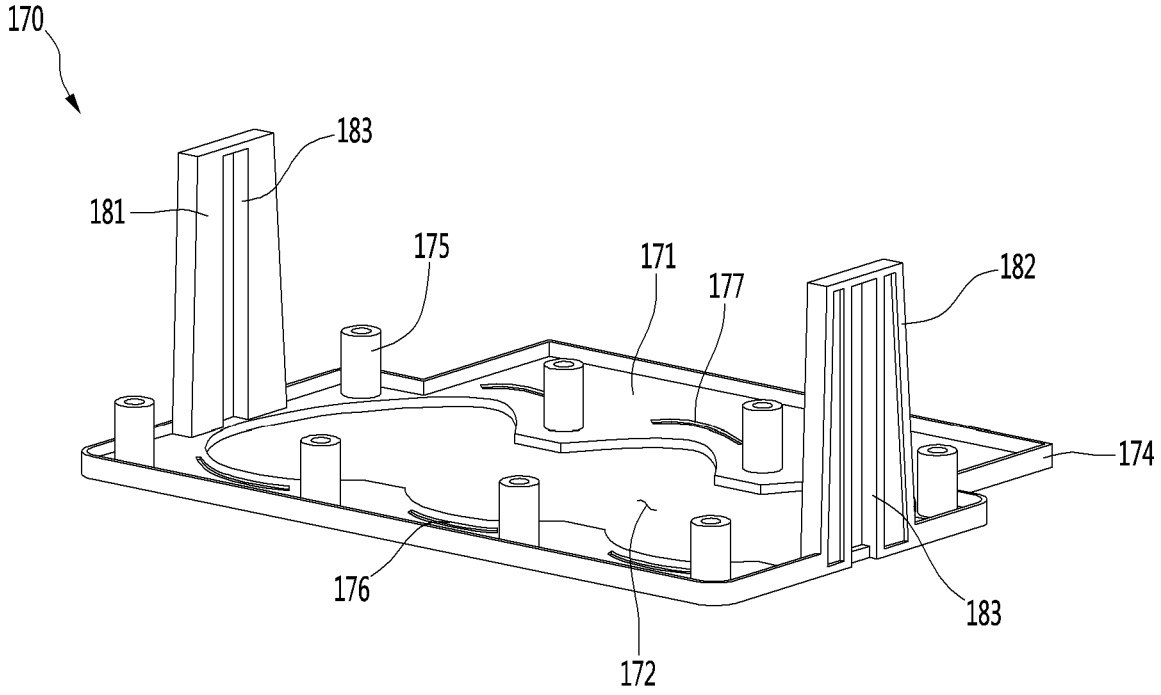
FIG. 10 is a top perspective view of an upper support according to an embodiment.
Figure 11:
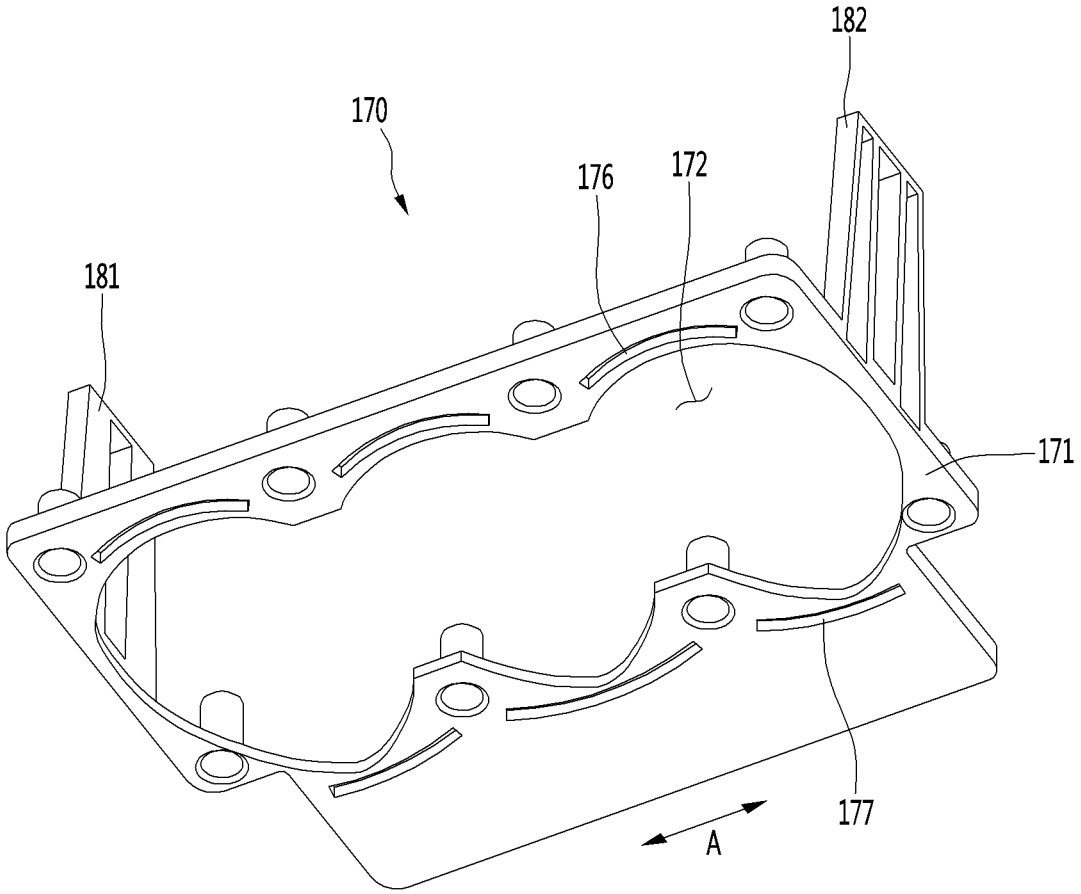
FIG. 11 is a bottom perspective view of the upper support according to an embodiment.

FIG. 10 is a top perspective view of the upper support according to an embodiment, and FIG. 11 is a bottom perspective view of the upper support according to an embodiment.

Referring to FIGS. 10 and 11, the upper support 170 may include a support plate 171 contacting the upper tray 150.

For example, a top surface of the support plate 171 may contact the bottom surface 164*b* of the horizontal extension part 164 of the upper tray 150.

A plate opening 172 through which the upper tray body 151 passes may be defined in the support plate 171.

A circumferential wall 174 that is bent upward may be provided on an edge of the support plate 171. For example, the circumferential wall 174 may contact at least a portion of a circumference of a side surface of the horizontal extension part 164.

Also, a top surface of the circumferential wall 174 may contact a bottom surface of the upper plate 121.

The support plate 171 may include a plurality of lower slots 176 and 177.

The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the support plate 171. Also, the plurality of second lower slots 177 may be disposed to be spaced apart from each other in the direction of the arrow A on the support plate 171.

The support plate 171 may further include a plurality of coupling bosses 175. The plurality of coupling bosses 175 may protrude upward from the top surface of the support plate 171.

Each of the coupling bosses 175 may pass through the through-hole 169 of the horizontal extension part 164 and be inserted into the sleeve 133 of the upper case 120.

In the state in which the coupling boss 175 is inserted into the sleeve 133, a top surface of the coupling boss 175 may be disposed at the same height as a top surface of the sleeve 133 or disposed at a height lower than that of the top surface of the sleeve 133.

A coupling member coupled to the coupling boss 175 may be, for example, a bolt (see reference symbol B1 of FIG. 3). The bolt B1 may include a body part and a head part having a diameter greater than that of the body part. The bolt B1 may be coupled to the coupling boss 175 from an upper side of the coupling boss 175.

While the body part of the bolt B1 is coupled to the coupling boss 175, when the head part contacts the top surface of the sleeve 133, and the head part contacts the top surface of the sleeve 133 and the top surface of the coupling boss 175, assembling of the upper assembly 110 may be completed.

The upper support 170 may further include a plurality of unit guides 181 and 182 for guiding the connection unit 350 connected to the upper ejector 300.

The plurality of unit guides 181 and 182 may be, for example, disposed to be spaced apart from each other in the direction of the arrow A with respect to FIG. 11.

The unit guides 181 and 182 may extend upward from the top surface of the support plate 171. Also, each of the unit guides 181 and 182 may be connected to the circumferential wall 174.

Each of the unit guides 181 and 182 may include a guide slot 183 vertically extends.

In a state in which both ends of the ejector body 310 of the upper ejector 300 pass through the guide slot 183, the connection unit 350 is connected to the ejector body 310.

Thus, when the rotation force is transmitted to the ejector body 310 by the connection unit 350 while the lower assembly 200 rotates, the ejector body 310 may vertically move along the guide slot 183.

<Upper Heater Coupling Structure>

Figure 12:
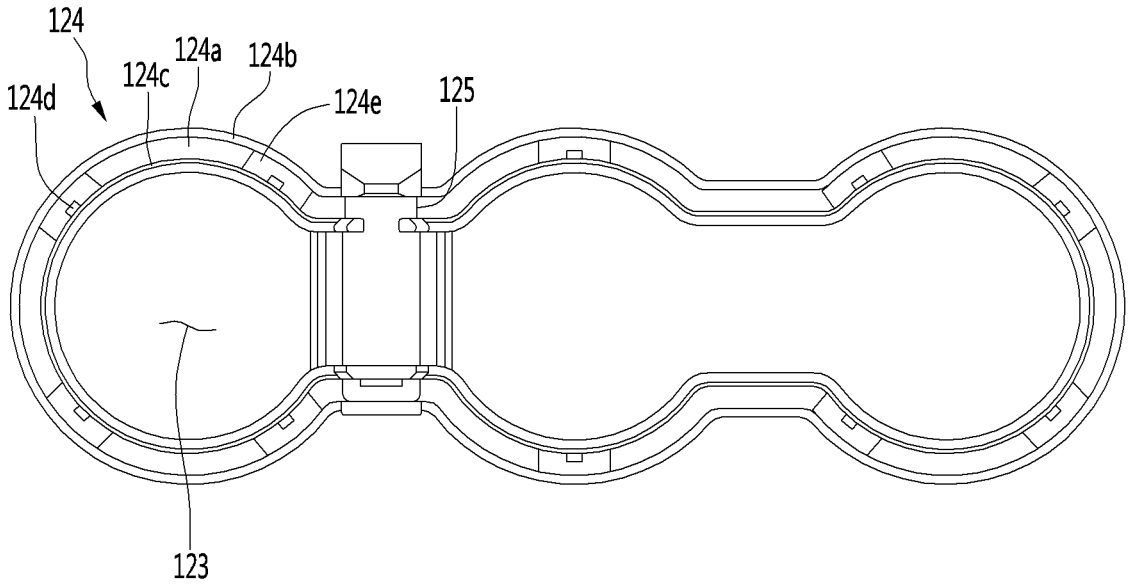
FIG. 12 is an enlarged view of a heater coupling part in the upper case of FIG. 5.
Figure 13:
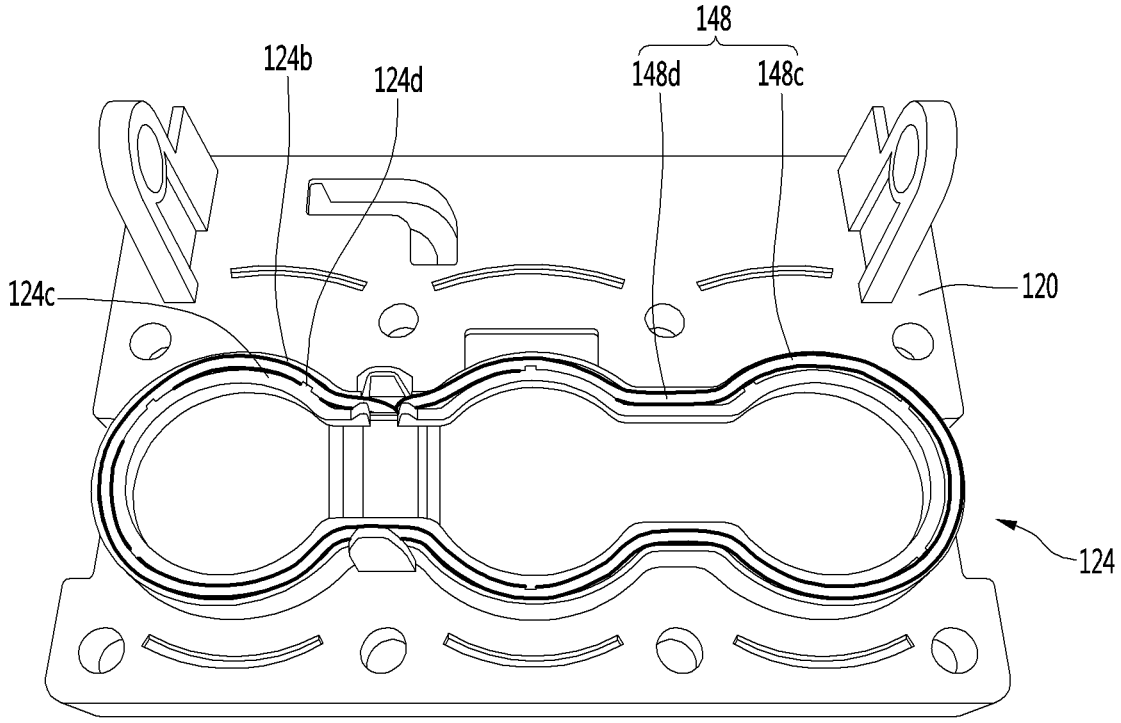
FIG. 13 is a view illustrating a state in which a heater is coupled to the upper case of FIG. 5.
Figure 14:
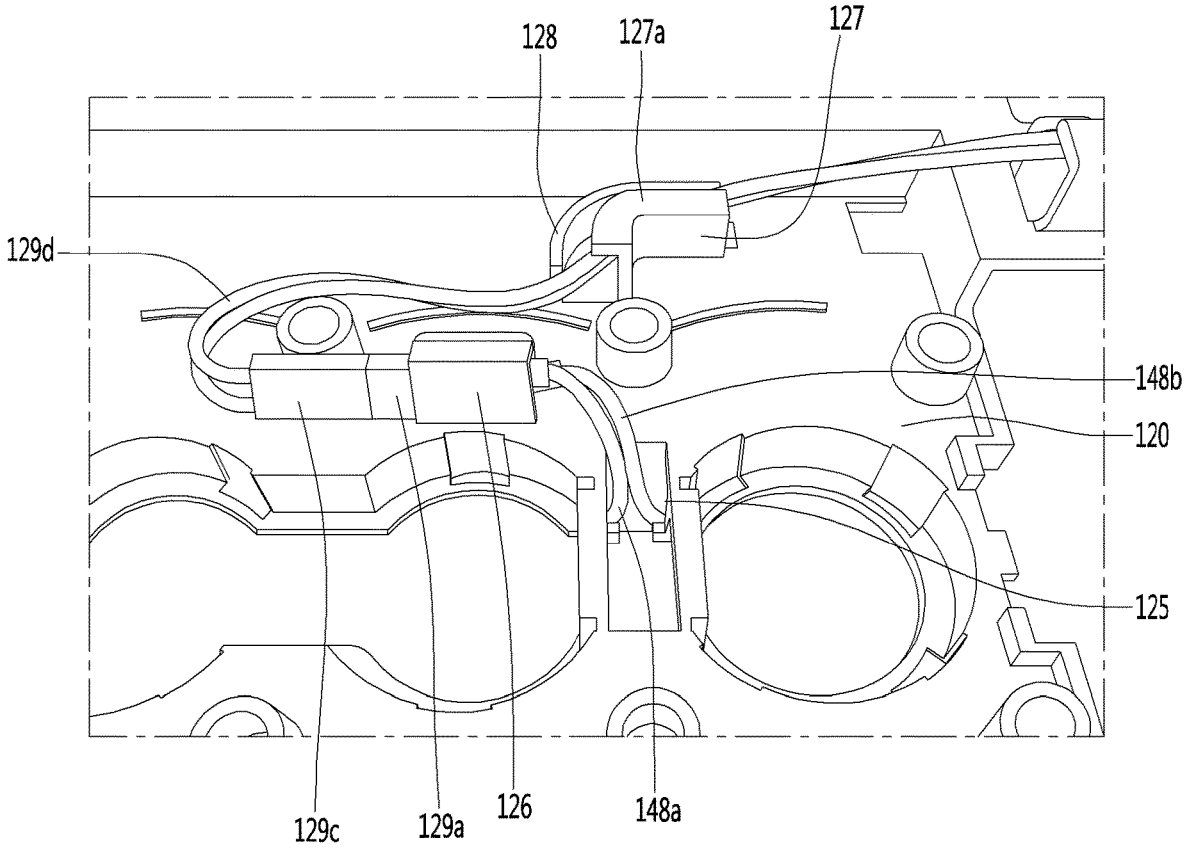
FIG. 14 is a view illustrating an arrangement of a wire connected to the heater in the upper case.

FIG. 12 is an enlarged view of the heater coupling part in the upper case of FIG. 5, FIG. 13 is a view illustrating a state in which a heater is coupled to the upper case of FIG. 5, and FIG. 14 is a view illustrating an arrangement of a wire connected to the heater in the upper case.

Referring to FIGS. 12 to 14, the heater coupling part 124 may include a heater accommodation groove 124*a* accommodating the upper heater 148.

For example, the heater accommodation groove 124*a* may be defined by recessing a portion of a bottom surface of the recess part 122 of the upper case 120 upward.

The heater accommodation groove 124*a* may extend along a circumference of the opening 123 of the upper case 120.

For example, the upper heater 148 may be a wire-type heater. Thus, the upper heater 148 may be bendable. The upper heater 148 may be bent to correspond to a shape of the heater accommodation groove 124*a* so as to accommodate the upper heater 148 in the heater accommodation groove 124*a*.

The upper heater 148 may be a DC heater receiving DC power. The upper heater 148 may be turned on to transfer ice.

When heat of the upper heater 148 is transferred to the upper tray 150, ice may be separated from a surface (inner surface) of the upper tray 150.

If the upper tray 150 is made of a metal material, and the heat of the upper heater 148 has a high temperature, a portion of the ice, which is heated by the upper heater 148, may be adhered again to the surface of the upper tray after the upper heater 148 is turned off. As a result, the ice may be opaque.

That is, an opaque band having a shape corresponding to the upper heater may be formed around the ice.

However, in this embodiment, since the DC heater having low output is used, and the upper tray 150 is made of the silicone material, an amount of heat transferred to the upper tray 150 may be reduced, and thus, the upper tray itself may have low thermal conductivity.

Thus, the heat may not be concentrated into the local portion of the ice, and a small amount of heat may be slowly applied to prevent the opaque band from being formed around the ice because the ice is effectively separated from the upper tray.

The upper heater 148 may be disposed to surround the circumference of each of the plurality of upper chambers 152 so that the heat of the upper heater 148 is uniformly transferred to the plurality of upper chambers 152 of the upper tray 150.

Also, the upper heater 148 may contact the circumference of each of the chamber walls 153 respectively defining the plurality of upper chambers 152. Here, the upper heater 148 may be disposed at a position that is lower than that of the upper opening 154.

Since the heater accommodation groove 124*a* is recessed from the recess part 122, the heater accommodation groove 124*a* may be defined by an outer wall 124*b* and an inner wall 124*c*.

The upper heater 148 may have a diameter greater than that of the heater accommodation groove 124*a* so that the upper heater 148 protrudes to the outside of the heater coupling part 124 in the state in which the upper heater 148 is accommodated in the heater accommodation groove 124*a*.

Since a portion of the upper heater 148 protrudes to the outside of the heater accommodation groove 124*a* in the state in which the upper heater 148 is accommodated in the heater accommodation groove 124*a*, the upper heater 148 may contact the upper tray 150.

A separation prevention protrusion 124*d* may be provided on one of the outer wall 124*b* and the inner wall 124*c* to prevent the upper heater 148 accommodated in the heater accommodation groove 124*a* from being separated from the heater accommodation groove 124*a*.

In FIG. 12, for example, a plurality of separation prevention protrusions 124*d* are provided on the inner wall 124*c*.

The separation prevention protrusion 124*d* may protrude from an end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater accommodation groove 124*a* without interfering with the insertion of the upper heater 148 by the separation prevention protrusion 124*d*.

As illustrated in FIG. 13, in the state in which the upper heater 148 is accommodated in the heater accommodation groove 124*a*, the upper heater 148 may be divided into a rounded portion 148*c* and a linear portion 148*d*.

That is, the heater accommodation groove 124*a* may include a rounded portion and a linear portion. Thus, the upper heater 148 may be divided into the rounded portion 148*c* and the linear portion 148*d* to correspond to the rounded portion and the linear portion of the heater accommodation groove 124*a*.

The rounded portion 148*c* may be a portion disposed along the circumference of the upper chamber 152 and also a portion that is bent to be rounded in a horizontal direction.

The liner portion 148*d* may be a portion connecting the rounded portions 148*c* corresponding to the upper chambers 152 to each other.

Since the upper heater 148 is disposed at a position lower than that of the upper opening 154, a line connecting two points of the rounded portions, which are spaced apart from each other, to each other may pass through upper chamber 152.

Since the rounded portion 148*c* of the upper heater 148 may be separated from the heater accommodation groove 124*a*, the separation prevention protrusion 124*d* may be disposed to contact the rounded portion 148*c*.

A through-opening 124*e* may be defined in a bottom surface of the heater accommodation groove 124*a*. When the upper heater 148 is accommodated in the heater accommodation groove 124*a*, a portion of the upper heater 148 may be disposed in the through-opening 124*e*. For example, the through-opening 124*e* may be defined in a portion of the upper heater 148 facing the separation prevention protrusion 124*d*.

When the upper heater 148 is bent to be horizontally rounded, tension of the upper heater 148 may increase to cause disconnection, and also, the upper heater 148 may be separated from the heater accommodation groove 124*a*.

However, when the through-opening 124*e* is defined in the heater accommodation groove 124*a* like this embodiment, a portion of the upper heater 148 may be disposed in the through-opening 124*e* to reduce the tension of the upper heater 148, thereby preventing the heater accommodation groove 124*a* from being separated from the upper heater 148.

As illustrated in FIG. 14, in a state in which a power input terminal 148*a* and a power output terminal 148*b* of the upper heater 148 are disposed in parallel to each other, the upper heater 148 may pass through a heater through-hole 125 defined in the upper case 120.

Since the upper heater 148 is accommodated from a lower side of the upper case 120, the power input terminal 148*a* and the power output terminal 148*b* of the upper heater 148 may extend upward to pass through the heater through-hole 125.

The power input terminal 148*a* and the power output terminal 148*b* passing through the heater through-hole 125 may be connected to one first connector 129*a*.

Also, a second connector 129*c* to which two wires 129*d* connected to correspond to the power input terminal 148*a* and the power output terminal 148*b* are connected may be connected to the first connector 129*a*.

A first guide part 126 guiding the upper heater 148, the first connector 129*a*, the second connector 129*c*, and the wire 129*d* may be provided on the upper plate 121 of the upper case 120.

In FIG. 14, for example, a structure in which the first guide part 126 guides the first connector 129*a* is illustrated.

The first guide part 126 may extend upward from the top surface of the upper plate 121 and have an upper end that is bent in the horizontal direction.

Thus, the upper bent portion of the first guide part 126 may limit upward movement of the first connector 129*a*.

The wire 129*d* may be led out to the outside of the upper case 120 after being bent in an approximately "U" shape to prevent interference with the surrounding structure.

Since the wire 129*d* is bent at least once, the upper case 120 may further include wire guides 127 and 128 for fixing a position of the wire 129*d*.

The wire guides 127 and 128 may include a first guide 127 and a second guide 128, which are disposed to be spaced apart from each other in the horizontal direction. The first guide 127 and the second guide 128 may be bent in a direction corresponding to the bending direction of the wire 129*d* to minimize damage of the wire 129*d* to be bent.

That is, each of the first guide 127 and the second guide 128 may include a curved portion.

To limit upward movement of the wire 129*d* disposed between the first guide 127 and the second guide 128, at least one of the first guide 127 and the second guide 128 may include an upper guide 127*a* extending toward the other guide.

Figure 15:
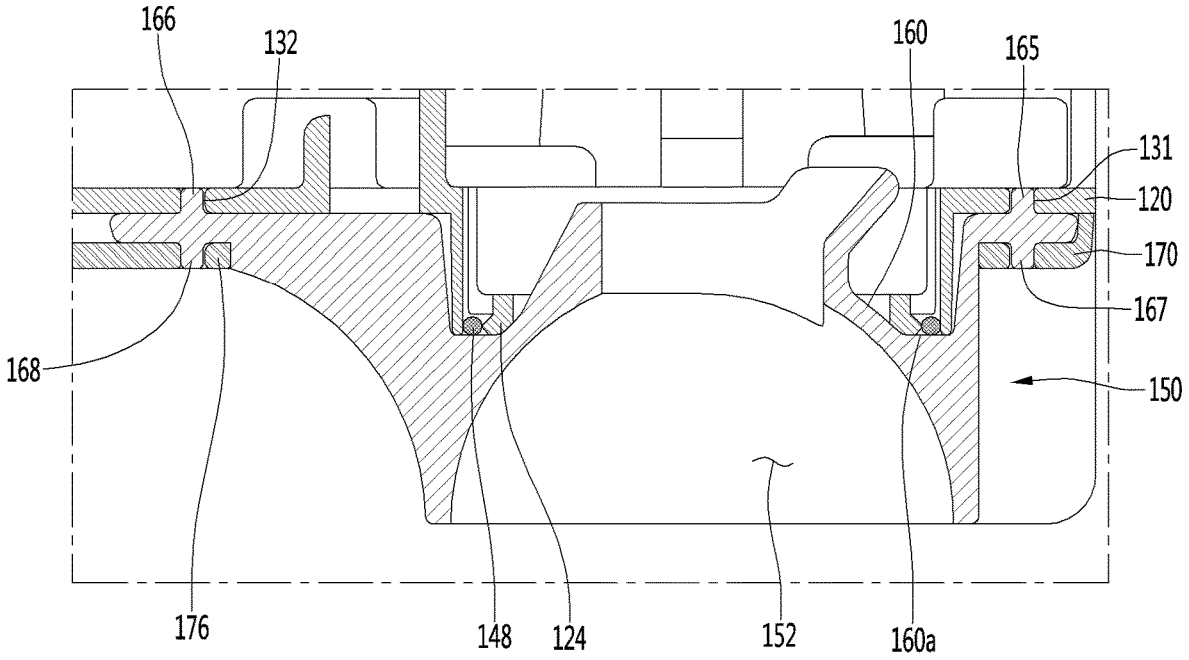
FIG. 15 is a cross-sectional view illustrating a state in which an upper assembly is assembled.

FIG. 15 is a cross-sectional view illustrating a state in which an upper assembly is assembled.

Referring to FIG. 15, in the state in which the upper heater 148 is coupled to the heater coupling part 124 of the upper case 120, the upper case 120, the upper tray 150, and the upper support 170 may be coupled to each other.

Also, the first upper protrusion 165 of the upper tray 150 may be inserted into the first upper slot 131 of the upper case 120. Also, the second upper protrusion 166 of the upper tray 150 may be inserted into the second upper slot 132 of the upper case 120.

Then, the first lower protrusion 167 of the upper tray 150 may be inserted into the first lower slot 176 of the upper support 170, and the second lower protrusion 168 of the upper tray 150 may be inserted into the second lower slot 177 of the upper support 170.

Thus, the coupling boss 175 of the upper support 170 may pass through the through-hole of the upper tray 150 and then be accommodated in the sleeve 133 of the upper case 120. In this state, the bolt B1 may be coupled to the coupling boss 175 from an upper side of the coupling boss 175.

In the state in which the bolt B1 is coupled to the coupling boss 175, the head part of the bolt B1 may be disposed at a position higher than that of the upper plate 121.

On the other hand, since the hinge supports 135 and 136 are disposed lower than the upper plate 121, while the lower assembly 200 rotates, the upper assembly 110 or the connection unit 350 may be prevented from interfering with the head part of the bolt B1.

While the upper assembly 110 is assembled, a plurality of unit guides 181 and 182 of the upper support 170 may protrude upward from the upper plate 121 through the through-opening (see reference numerals 139*a* and 139*b* of FIG. 5) defined in both sides of the upper plate 121.

As described above, the upper ejector 300 passes through the guide slots 183 of the unit guides 181 and 182 protruding upward from the upper plate 121.

Thus, the upper ejector 300 may descend in the state of being disposed above the upper plate 121 and be inserted into the upper chamber 152 to separate ice of the upper chamber 152 from the upper tray 150.

When the upper assembly 110 is assembled, the heater coupling part 124 to which the upper heater 148 is coupled may be accommodated in the first accommodation part 160 of the upper tray 150.

In the state in which the heater coupling part 124 is accommodated in the first accommodation part 160, the upper heater 148 may contact the bottom surface 160*a* of the first accommodation part 160.

Like this embodiment, when the upper heater 148 is accommodated in the heater coupling part 124 having the recessed shape to contact the upper tray body 151, heat of the upper heater 148 may be minimally transferred to other portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the rounded portion 148*c* of the upper heater 148 may vertically overlap the upper chamber 152.

That is, a maximum distance between two points of the rounded portion 148*c*, which are disposed at opposite sides with respect to the upper chamber 152 may be less than a diameter of the upper chamber 152.

<Lower Case>

Figure 16:
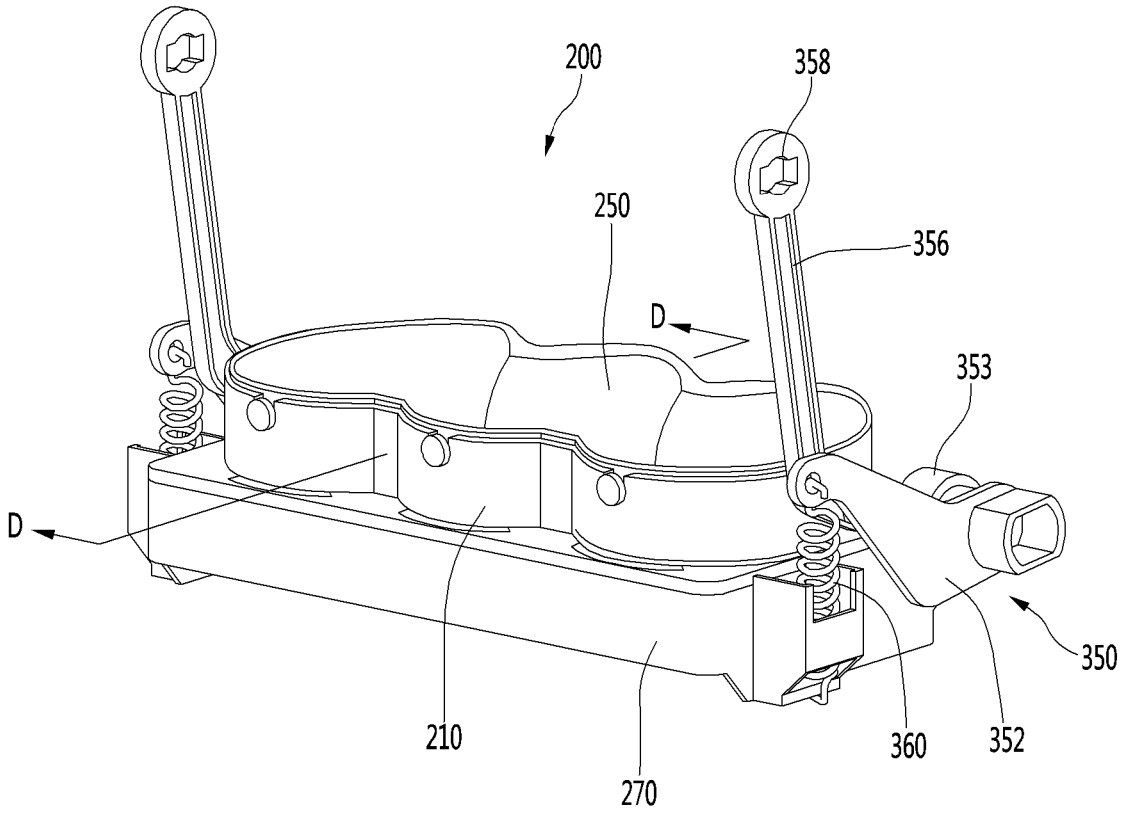
FIG. 16 is a perspective view of a lower assembly according to an embodiment.
Figure 17:
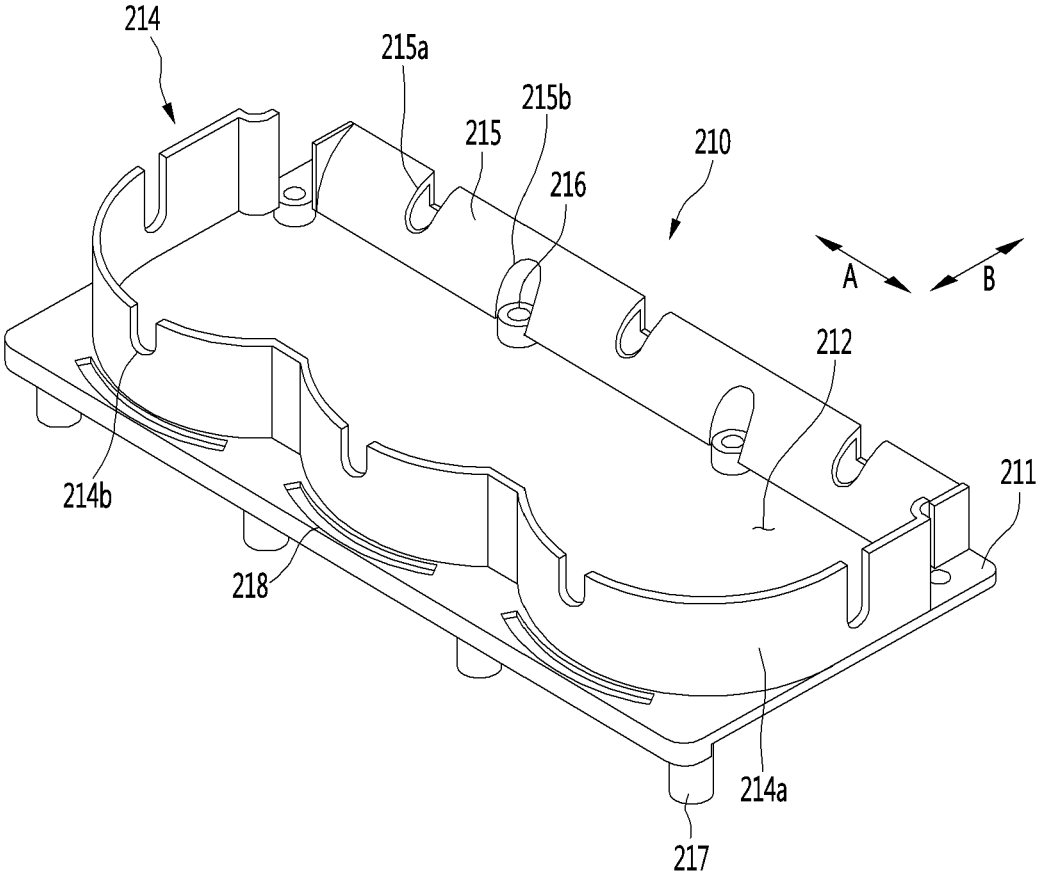
FIG. 17 is a top perspective view of a lower case according to an embodiment.
Figure 18:
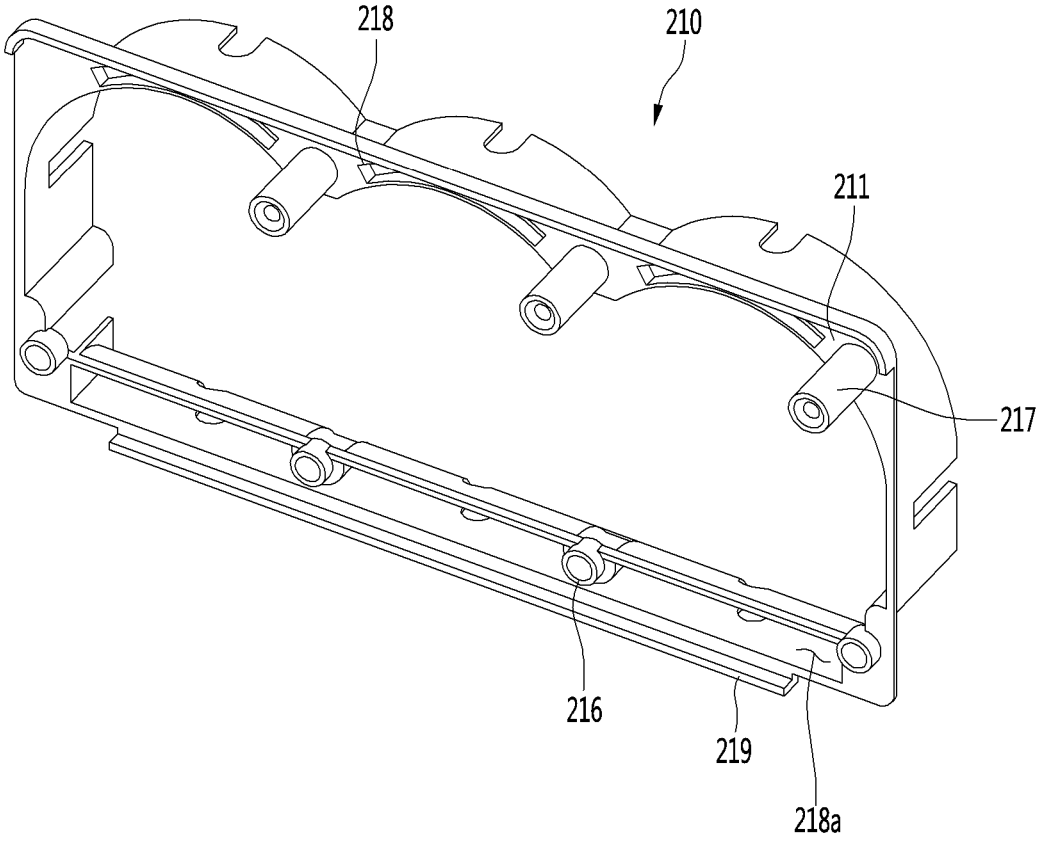
FIG. 18 is a bottom perspective view of the lower case according to an embodiment.

FIG. 16 is a perspective view of a lower assembly according to an embodiment, FIG. 17 is a top perspective view of a lower case according to an embodiment, and FIG. 18 is a bottom perspective view of the lower case according to an embodiment.

Referring to FIGS. 16 to 18, the lower assembly 200 may include a lower tray 250, a lower support 270, and a lower case 210.

The lower case 210 may surround the circumference of the lower tray 250, and the lower support 270 may support the lower tray 250.

Also, the connection unit 350 may be coupled to the lower support 270.

The connection unit 350 may include a first link 352 that receives power of the driving unit 180 to allow the lower support 270 to rotate and a second link 356 connected to the lower support 270 to transmit rotation force of the lower support 270 to the upper ejector 300 when the lower support 270 rotates.

The first link 352 and the lower support 270 may be connected to each other by an elastic member 360. For example, the elastic member 360 may be a coil spring.

The elastic member 360 may have one end connected to the first link 362 and the other end connected to the lower support 270.

The elastic member 360 provide elastic force to the lower support 270 so that contact between the upper tray 150 and the lower tray 250 is maintained.

In this embodiment, the first link 352 and the second link 356 may be disposed on both sides of the lower support 270, respectively.

Also, one of the two first links may be connected to the driving unit 180 to receive the rotation force from the driving unit 180.

The two first links 352 may be connected to each other by a connection shaft (see reference numeral 370 of FIG. 4).

A hole 358 through which the ejector body 310 of the upper ejector 300 passes may be defined in an upper end of the second link 356.

The lower case 210 may include a lower plate 211 for fixing the lower tray 250.

A portion of the lower tray 250 may be fixed to contact a bottom surface of the lower plate 211.

An opening 212 through which a portion of the lower tray 250 passes may be defined in the lower plate 211.

For example, when the lower tray 250 is fixed to the lower plate 211 in a state in which the lower tray 250 is disposed below the lower plate 211, a portion of the lower tray 250 may protrude upward from the lower plate 211 through the opening 212.

The lower case 210 may further include a circumferential wall 214 (or a cover wall) surrounding the lower tray 250 passing through the lower plate 211.

The circumferential wall 214 may include a vertical wall 214*a* and a curved wall 215.

The vertical wall 214*a* is a wall vertically extending upward from the lower plate 211. The curved wall 215 is a wall that is rounded in a direction that is away from the opening 212 upward from the lower plate 211.

The vertical wall 214*a* may include a first coupling slit 214*b* coupled to the lower tray 250. The first coupling slit 214*b* may be defined by recessing an upper end of the vertical wall downward.

The curved wall 215 may include a second coupling slit 215*a* to the lower tray 250.

The second coupling slit 215*a* may be defined by recessing an upper end of the curved wall 215 downward.

The lower case 210 may further include a first coupling boss 216 and a second coupling boss 217.

The first coupling boss 216 may protrude downward from the bottom surface of the lower plate 211. For example, the plurality of first coupling bosses 216 may protrude downward from the lower plate 211.

The plurality of first coupling bosses 216 may be arranged to be spaced apart from each other in the direction of the arrow A with respect to FIG. 17.

The second coupling boss 217 may protrude downward from the bottom surface of the lower plate 211. For example, the plurality of second coupling bosses 217 may protrude from the lower plate 211. The plurality of first coupling bosses 217 may be arranged to be spaced apart from each other in the direction of the arrow A with respect to FIG. 17.

The first coupling boss 216 and the second coupling boss 217 may be disposed to be spaced apart from each other in the direction of the arrow B.

In this embodiment, a length of the first coupling boss 216 and a length of the second coupling boss 217 may be different from each other. For example, the first coupling boss 216 may have a length less than that of the second coupling boss 217.

The first coupling member may be coupled to the first coupling boss 216 at an upper portion of the first coupling boss 216. On the other hand, the second coupling member may be coupled to the second coupling boss 217 at a lower portion of the second coupling boss 217.

A groove 215*b* for movement of the coupling member may be defined in the curved wall 215 to prevent the first coupling member from interfering with the curved wall 215 while the first coupling member is coupled to the first coupling boss 216.

The lower case 210 may further include a slot 218 coupled to the lower tray 250.

A portion of the lower tray 250 may be inserted into the slot 218. The slot 218 may be disposed adjacent to the vertical wall 214*a*.

For example, a plurality of slots 218 may be defined to be spaced apart from each other in the direction of the arrow A of FIG. 17. Each of the slots 218 may have a curved shape.

The lower case 210 may further include an accommodation groove 218*a* into which a portion of the lower tray 250 is inserted. The accommodation groove 218*a* may be defined by recessing a portion of the lower plate 211 toward the curved wall 215.

The lower case 210 may further include an extension wall 219 contacting a portion of the circumference of the side surface of the lower plate 211 in the state of being coupled to the lower tray 250. The extension wall 219 may linearly extend in the direction of the arrow A.

<Lower Tray>

Figure 19:
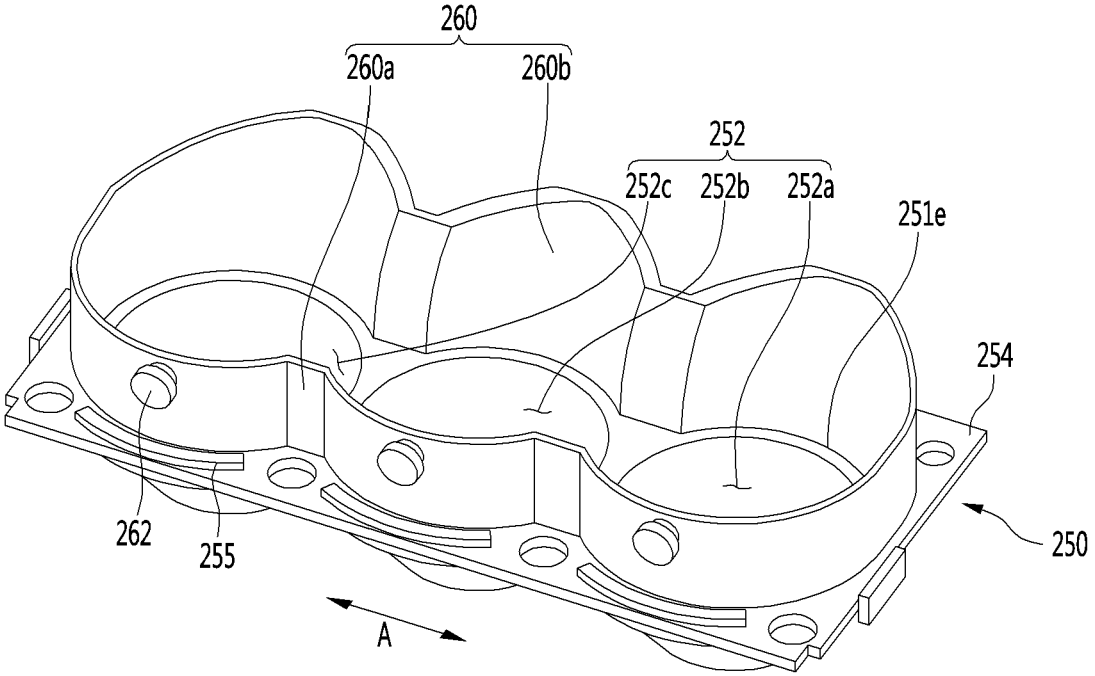
FIG. 19 is a top perspective view of a lower tray according to an embodiment.
Figure 20:
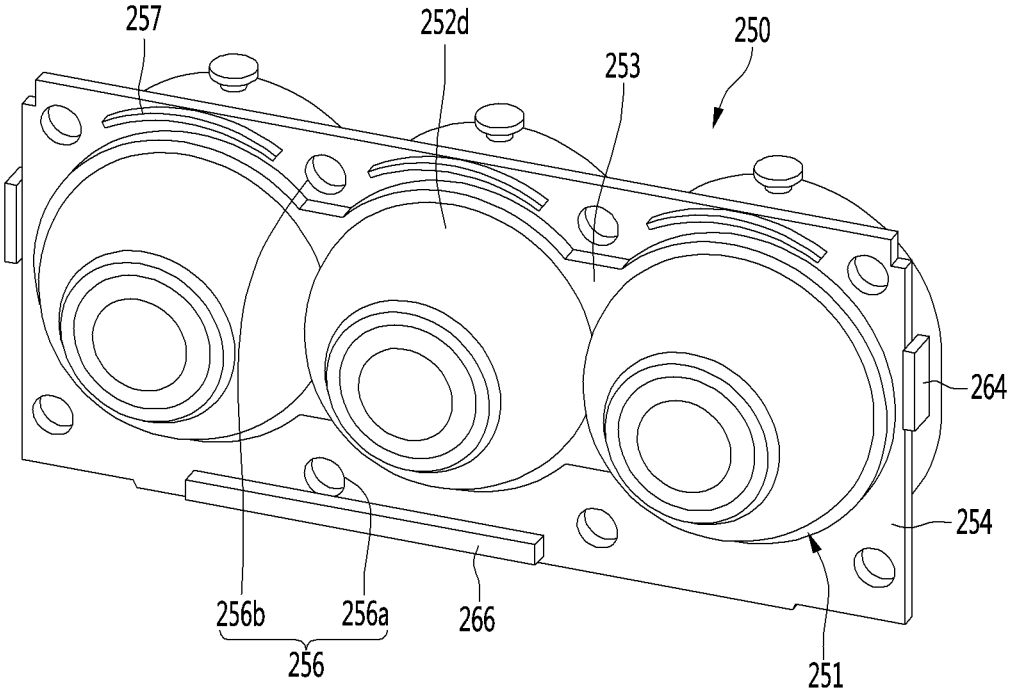
FIGS. 20 and 21 are bottom perspective views of the lower tray according to an embodiment.
Figure 21:
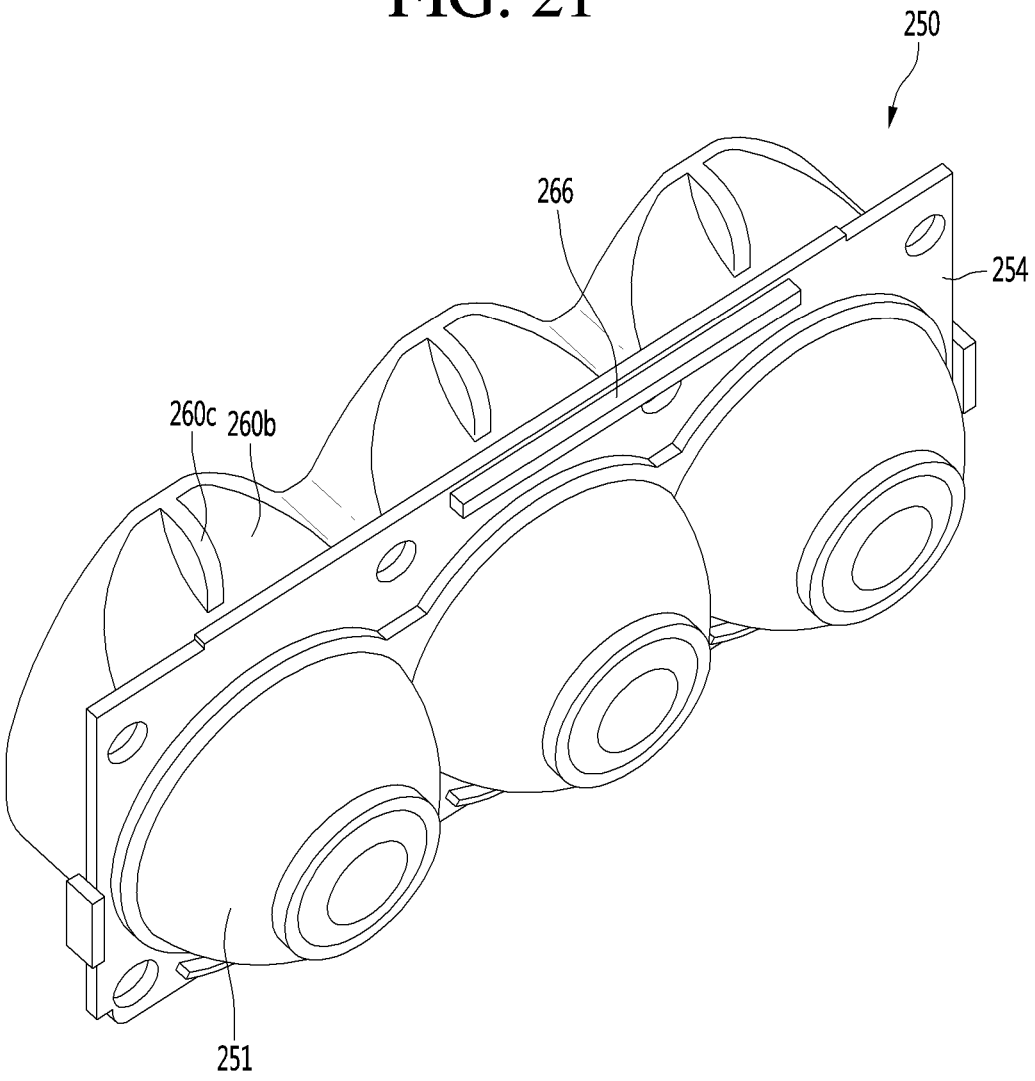
Figure 22:
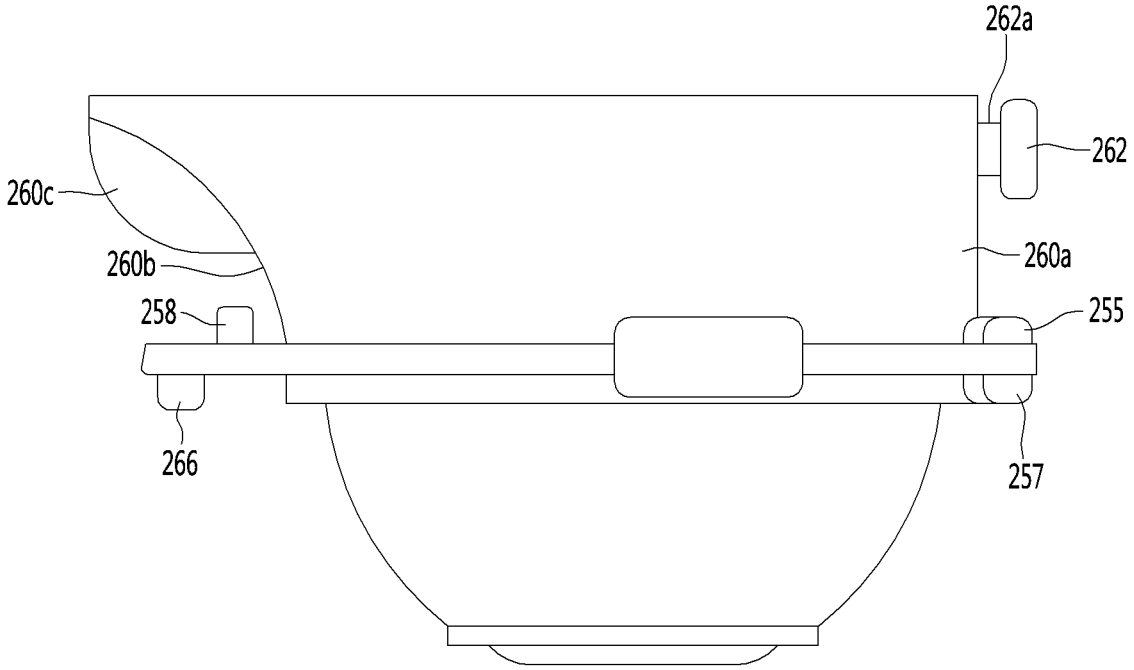
FIG. 22 is a side view of the lower tray according to an embodiment.

FIG. 19 is a top perspective view of the lower tray according to an embodiment, FIGS. 20 and 21 are bottom perspective views of the lower tray according to an embodiment, and FIG. 22 is a side view of the lower tray according to an embodiment.

Referring to FIGS. 19 to 22, the lower tray 250 may be made of a flexible material that is capable of being restored to its original shape after being deformed by an external force.

For example, the lower tray 250 may be made of a silicone material. Like this embodiment, when the lower tray 250 is made of a silicone material, the lower tray 250 may be restored to its original shape even through external force is applied to deform the lower tray 250 during the ice separating process. Thus, in spite of repetitive ice making, spherical ice may be made.

If the lower tray 250 is made of a metal material, when the external force is applied to the lower tray 250 to deform the lower tray 250 itself, the lower tray 250 may not be restored to its original shape any more.

In this case, after the lower tray 250 is deformed in shape, the spherical ice may not be made. That is, it is impossible to repeatedly make the spherical ice.

On the other hand, like this embodiment, when the lower tray 250 is made of the flexible material that is capable of being restored to its original shape, this limitation may be solved.

Also, when the lower tray 250 is made of the silicone material, the lower tray 250 may be prevented from being melted or thermally deformed by heat provided from an upper heater that will be described later.

The lower tray 250 may include a lower tray body 251 defining a lower chamber 252 that is a portion of the ice chamber 111.

The lower tray body 251 may be define a plurality of lower chambers 252.

For example, the plurality of lower chambers 252 may include a first lower chamber 252*a*, a second lower chamber 252*b*, and a third lower chamber 252*c*.

The lower tray body 251 may include three chamber walls 252*d* defining three independent lower chambers 252*a*, 252*b*, and 252*c*. The three chamber walls 252*d* may be integrated in one body to form the lower tray body 251.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 19.

The lower chamber 252 may have a hemispherical shape or a shape similar to the hemispherical shape. That is, a lower portion of the spherical ice may be made by the lower chamber 252.

In this specification, the shape similar to the hemispherical shape is not a completely hemispherical shape, but a shape that is close to the hemispherical shape.

The lower tray 250 may further include a first extension part 253 horizontally extending from an edge of an upper end of the lower tray body 251. The first extension part 253 may be continuously formed along the circumference of the lower tray body 251.

The lower tray 250 may further include a circumferential wall 260 extending upward from a top surface of the first extension part 253.

The bottom surface of the upper tray body 151 may contact a top surface 251*e* of the lower tray body 251.

The circumferential wall 260 may surround the upper tray body 251 seated on the top surface 251*e* of the lower tray body 251.

The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension part 253. The second wall 260*b* is a curved wall having a shape corresponding to that of the upper tray body 151. That is, the second wall 260*b* may be rounded upward from the first extension part 253 in a direction that is away from the lower chamber 252.

The lower tray 250 may further include a second extension part 254 horizontally extending from the circumferential wall 260.

The second extension part 254 may be disposed higher than the first extension part 253. Thus, the first extension part 253 and the second extension part 254 may be stepped with respect to each other.

The second extension part 254 may include a first upper protrusion 255 inserted into the slot 218 of the lower case 210. The first upper protrusion 255 may be disposed to be horizontally spaced apart from the circumferential wall 260.

For example, the first upper protrusion 255 may protrude upward from a top surface of the second extension part 254 at a position adjacent to the first wall 260*a*.

Although not limited, a plurality of first upper protrusions 255 may be arranged to be spaced apart from each other in the direction of the arrow A with respect to FIG. 19. The first upper protrusion 255 may extend, for example, in a curved shape.

The second extension part 254 may include a first lower protrusion 257 inserted into a protrusion groove of the lower case 210, which will be described later. The first lower protrusion 257 may protrude downward from a bottom surface of the second extension part 254.

Although not limited, the plurality of first lower protrusions 257 may be arranged to be spaced apart from each other in the direction of arrow A.

The first upper protrusion 255 and the first lower protrusion 257 may be disposed at opposite sides with respect to a vertical direction of the second extension part 254. At least a portion of the first upper protrusion 255 may vertically overlap the second lower protrusion 257.

A plurality of through-holes may be defined in the second extension part 254.

The plurality of through-holes 256 may include a first through-hole 256*a* through which the first coupling boss 216 of the lower case 210 passes and a second through-hole 256*b* through which the second coupling boss 217 of the lower case 210 passes.

For example, the plurality of through-holes 256*a* may be defined to be spaced apart from each other in the direction of the arrow A of FIG. 19.

Also, the plurality of second through-holes 256*b* may be disposed to be spaced apart from each other in the direction of the arrow A of FIG. 19.

The plurality of first through-holes 256*a* and the plurality of second through-holes 256*b* may be disposed at opposite sides with respect to the lower chamber 252.

A portion of the plurality of second through-holes 256*b* may be defined between the two first upper protrusions 255. Also, a portion of the plurality of second through-holes 256*b* may be defined between the two first lower protrusions 257.

The second extension part 254 may further a second upper protrusion 258. The second upper protrusion 258 may be disposed at an opposite side of the first upper protrusion 255 with respect to the lower chamber 252.

The second upper protrusion 258 may be disposed to be horizontally spaced apart from the circumferential wall 260. For example, the second upper protrusion 258 may protrude upward from a top surface of the second extension part 254 at a position adjacent to the second wall 260*b*.

Although not limited, the plurality of second upper protrusions 258 may be arranged to be spaced apart from each other in the direction of the arrow A of FIG. 19.

The second upper protrusion 258 may be accommodated in the accommodation groove 218*a* of the lower case 210. In the state in which the second upper protrusion 258 is accommodated in the accommodation groove 218*a*, the second upper protrusion 258 may contact the curved wall 215 of the lower case 210.

The circumferential wall 260 of the lower tray 250 may include a first coupling protrusion 262 coupled to the lower case 210.

The first coupling protrusion 262 may horizontally protrude from the first wall 260*a* of the circumferential wall 260. The first coupling protrusion 262 may be disposed on an upper portion of a side surface of the first wall 260*a*.

The first coupling protrusion 262 may include a neck part 262*a* having a relatively less diameter when compared to those of other portions. The neck part 262*a* may be inserted into a first coupling slit 214*b* defined in the circumferential wall 214 of the lower case 210.

The circumferential wall 260 of the lower tray 250 may further include a second coupling protrusion 262*c* coupled to the lower case 210.

The second coupling protrusion 262*c* may horizontally protrude from the second wall 260*b* of the circumferential wall 260. The second coupling protrusion 260*c* may be inserted into a second coupling slit 215*a* defined in the circumferential wall 214 of the lower case 210.

The second extension part 254 may include a second lower protrusion 266. The second lower protrusion 266 may be disposed at an opposite side of the second lower protrusion 257 with respect to the lower chamber 252.

The second lower protrusion 266 may protrude downward from a bottom surface of the second extension part 254. For example, the second lower protrusion 266 may linearly extend.

A portion of the plurality of first through-holes 256*a* may be defined between the second lower protrusion 266 and the lower chamber 252.

The second lower protrusion 266 may be accommodated in a guide groove defined in the lower support 270, which will be described later.

The second extension part 254 may further a side restriction part 264. The side restriction part 264 restricts horizontal movement of the lower tray 250 in the state in which the lower tray 250 is coupled to the lower case 210 and the lower support 270.

The side restriction part 264 laterally protrudes from the second extension part 254 and has a vertical length greater than a thickness of the second extension part 254. For example, one portion of the side restriction part 264 may be disposed higher than the top surface of the second extension part 254, and the other portion of the side restriction part 264 may be disposed lower than the bottom surface of the second extension part 254.

Thus, the one portion of the side restriction part 264 may contact a side surface of the lower case 210, and the other portion may contact a side surface of the lower support 270.

<Lower Support>

Figure 23:
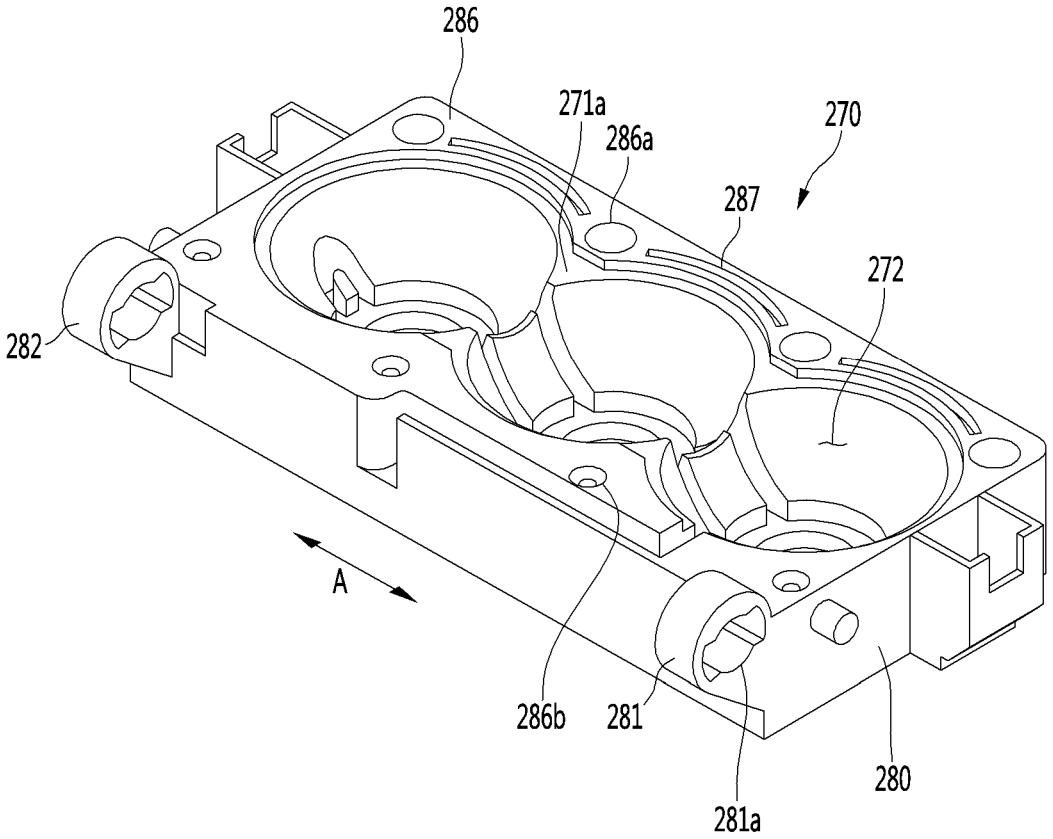
FIG. 23 is a top perspective view of a lower support according to an embodiment.
Figure 24:
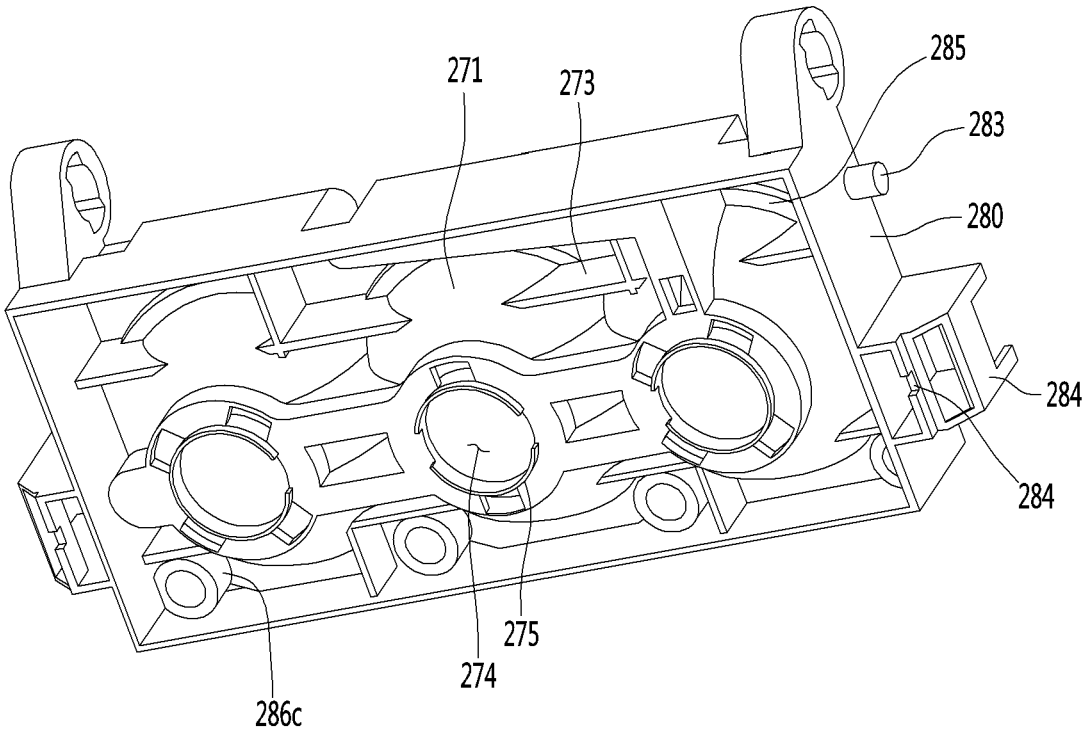
FIG. 24 is a bottom perspective view of the lower support according to an embodiment.
Figure 25:
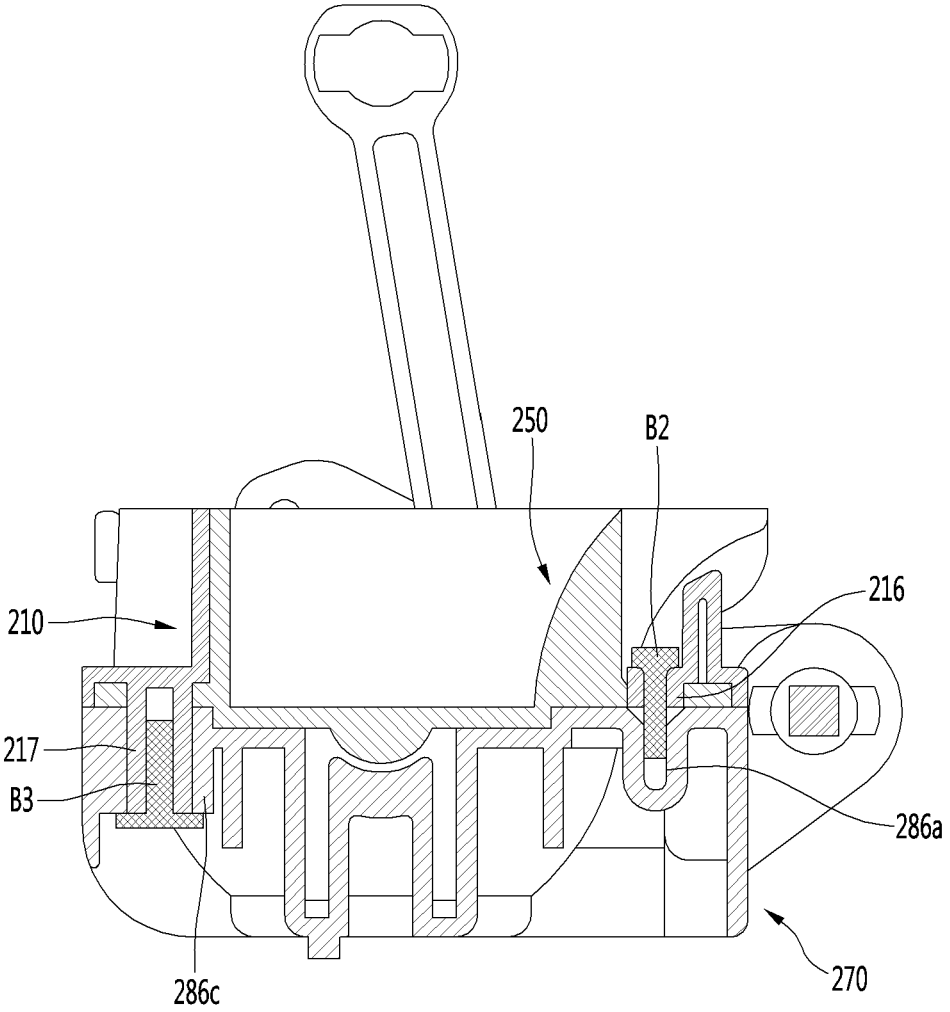
FIG. 25 is a cross-sectional view taken along line D-D of FIG. 16, for illustrating a state in which the lower assembly is assembled.

FIG. 23 is a top perspective view of the lower support according to an embodiment, FIG. 24 is a bottom perspective view of the lower support according to an embodiment, and FIG. 25 is a cross-sectional view taken along line D-D of FIG. 16, for illustrating a state in which the lower assembly is assembled.

Referring to FIGS. 23 to 25, the lower support 270 may include a support body 271 supporting the lower tray 250.

The support body 271 may include three chamber accommodation parts 272 accommodating the three chamber walls 252*d* of the lower tray 250. The chamber accommodation part 272 may have a hemispherical shape.

The support body 271 may have a lower opening 274 through which the lower ejector 400 passes during the ice separating process. For example, three lower openings 274 may be defined to correspond to the three chamber accommodation parts 272 in the support body 271.

A reinforcement rib 275 reinforcing strength may be disposed along a circumference of the lower opening 274.

Also, the adjacent two chamber walls 252*d* of the three chamber walls 252*d* may be connected to each other by a connection rib 273. The connection rib 273 may reinforce strength of the chamber wells 252*d*.

The lower support 270 may further include a first extension wall 285 horizontally extending from an upper end of the support body 271.

The lower support 270 may further include a second extension wall 286 that is formed to be stepped with respect to the first extension wall 285 on an edge of the first extension wall 285.

A top surface of the second extension wall 286 may be disposed higher than the first extension wall 285.

The first extension part 253 of the lower tray 250 may be seated on a top surface 271*a* of the support body 271, and the second extension part 254 may surround side surface of the first extension part 253 of the lower tray 250. Here, the second extension wall 286 may contact the side surface of the first extension part 253 of the lower tray 250.

The lower support 270 may further include a protrusion groove 287 accommodating the first lower protrusion 257 of the lower tray 250.

The protrusion groove 287 may extend in a curved shape. The protrusion groove 287 may be defined, for example, in a second extension wall 286.

The lower support 270 may further include a first coupling groove 286*a* to which a first coupling member B2 passing through the first coupling boss 216 of the upper case 210 is coupled.

The first coupling groove 286*a* may be provided, for example, in the second extension wall 286.

The plurality of first coupling grooves 286*a* may be disposed to be spaced apart from each other in the direction of the arrow A in the second extension wall 286. A portion of the plurality of first coupling grooves 286*a* may be defined between the adjacent two protrusion grooves 287.

The lower support 270 may further include a boss through-hole 286*b* through which the second coupling boss 217 of the upper case 210 passes.

The boss through-hole 286*b* may be provided, for example, in the second extension wall 286. A sleeve 286*c* surrounding the second coupling boss 217 passing through the boss through-hole 286*b* may be disposed on the second extension wall 286. The sleeve 286*c* may have a cylindrical shape with an opened lower portion.

The first coupling member B2 may be coupled to the first coupling groove 286*a* after passing through the first coupling boss 216 from an upper side of the lower case 210.

The second coupling member B3 may be coupled to the second coupling boss 217 from a lower side of the lower support 270.

The sleeve 286*c* may have a lower end that is disposed at the same height as a lower end of the second coupling boss 217 or disposed at a height lower than that of the lower end of the second coupling boss 217.

Thus, while the second coupling member B3 is coupled, the head part of the second coupling member B3 may contact bottom surfaces of the second coupling boss 217 and the sleeve 286*c* or may contact a bottom surface of the sleeve 286*c*.

The lower support 270 may further include an outer wall 280 disposed to surround the lower tray body 251 in a state of being spaced outward from the outside of the lower tray body 251.

The outer wall 280 may, for example, extend downward along an edge of the second extension wall 286.

The lower support 270 may further include a plurality of hinge bodies 281 and 282 respectively connected to hinge supports 135 and 136 of the upper case 210.

The plurality of hinge bodies 281 and 282 may be disposed to be spaced apart from each other in a direction of an arrow A of FIG. 23. Each of the hinge bodies 281 and 282 may further include a second hinge hole 281*a*.

The shaft connection part 353 of the first link 352 may pass through the second hinge hole 281. The connection shaft 370 may be connected to the shaft connection part 353.

A distance between the plurality of hinge bodies 281 and 282 may be less than that between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 383 may be disposed on each of both surfaces of the outer wall 280.

Also, the lower support 270 may further include an elastic member coupling part 284 to which the elastic member 360 is coupled. The elastic member coupling part 284 may define a space in which a portion of the elastic member 360 is accommodated. Since the elastic member 360 is accommodated in the elastic member coupling part 284 to prevent the elastic member 360 from interfering with the surrounding structure.

Also, the elastic member coupling part 284 may include a hook part 284*a* on which a lower end of the elastic member 360 is hooked.

<Coupling Structure of Lower Heater>

Figure 26:
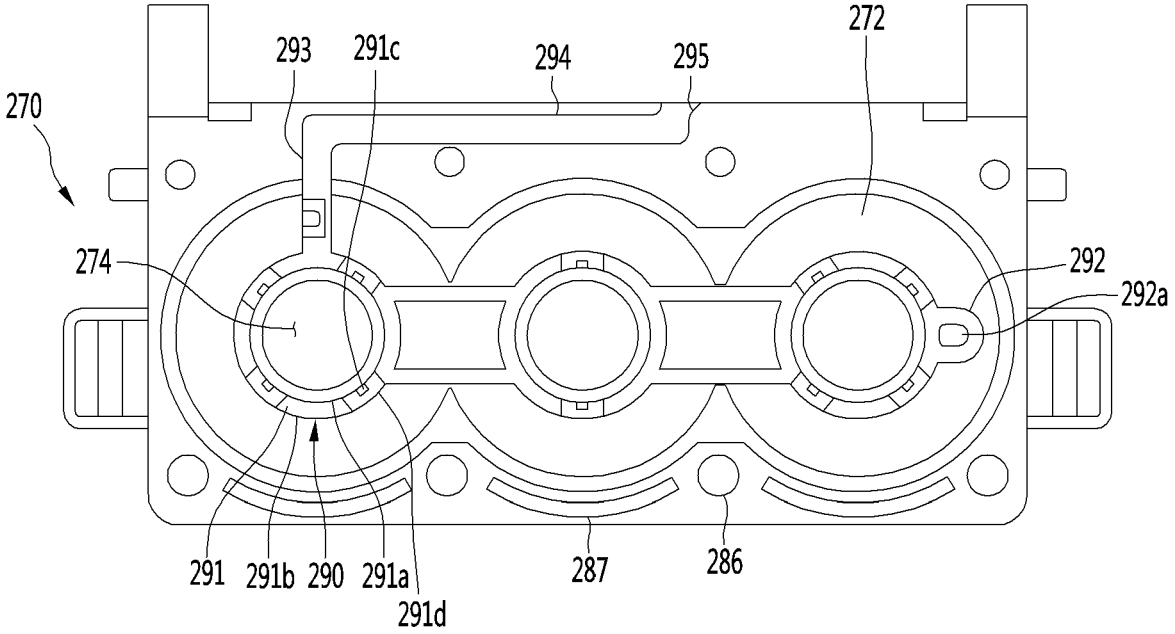
FIG. 26 is a plan view of the lower support according to an embodiment.
Figure 27:
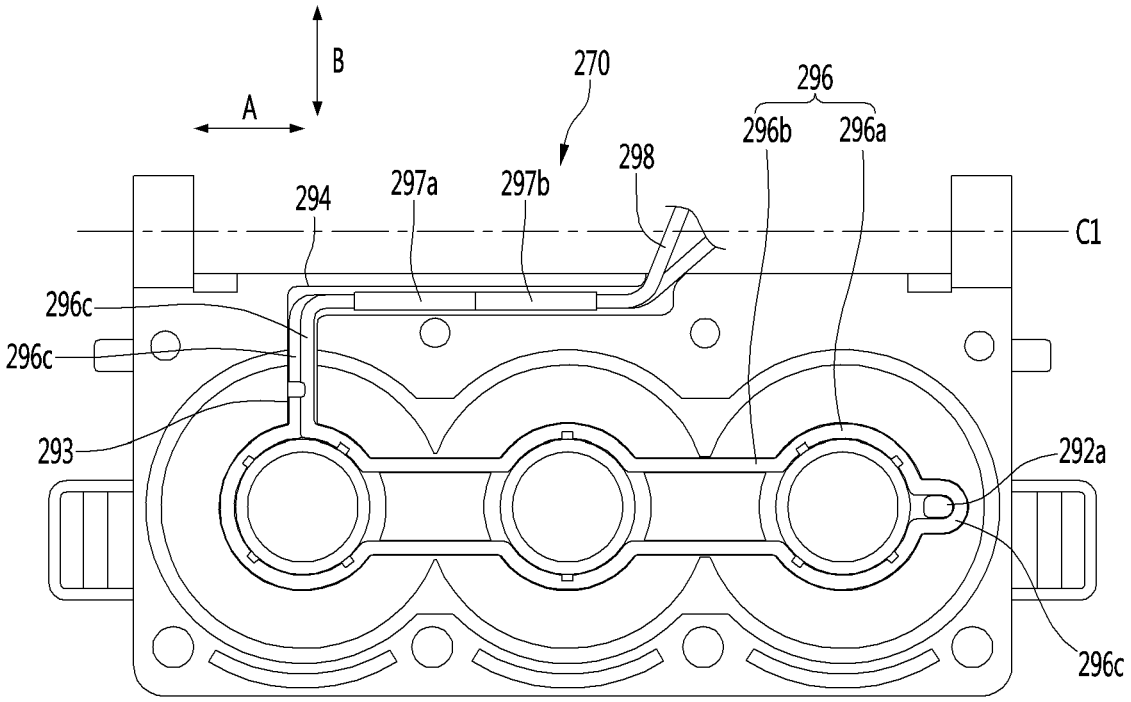
FIG. 27 is a perspective view illustrating a state in which a lower heater is coupled to the lower support of FIG. 26.
Figure 28:
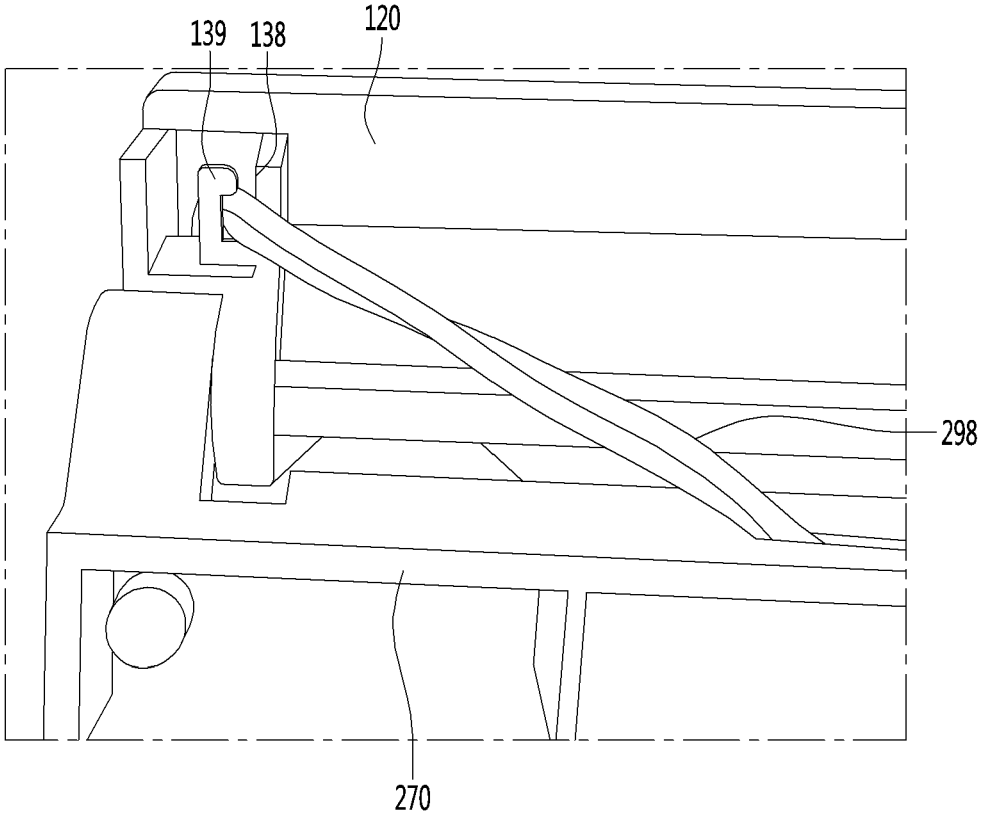
FIG. 28 is a view illustrating a state in which the wire connected to the lower heater passes through the upper case in a state in which the lower assembly is coupled to the upper assembly.

FIG. 26 is a plan view of the lower support according to an embodiment, FIG. 27 is a perspective view illustrating a state in which a lower heater is coupled to the lower support of FIG. 26, and FIG. 28 is a view illustrating a state in which the wire connected to the lower heater passes through the upper case in a state in which the lower assembly is coupled to the upper assembly.

Referring to FIGS. 26 to 28, the ice maker 100 according to this embodiment may further include a lower heater 296 for applying heat to the lower tray 250 during the ice making process.

The lower heater 297 may provide the heat to the lower chamber 252 during the ice making process so that ice within the ice chamber 111 is frozen from an upper side.

Also, since lower heater 296 generates heat in the ice making process, bubbles within the ice chamber 111 may move downward during the ice making process. When the ice is completely made, a remaining portion of the spherical ice except for the lowermost portion of the ice may be transparent. According to this embodiment, the spherical ice that is substantially transparent may be made.

For example, the lower heater 296 may be a wire-type heater.

The lower heater 296 may be installed on the lower support 270. Also, the lower heater 296 may contact the lower tray 250 to provide heat to the lower chamber 252.

For example, the lower heater 296 may contact the lower tray body 251. Also, the lower heater 296 may be disposed to surround the three chamber walls 252*d* of the lower tray body 251.

The lower support 270 may further include a heater coupling part 290 to which the lower heater 296 is coupled.

The heater coupling part 290 may include a heater accommodation groove 291 that is recessed downward from the chamber accommodation part 272 of the lower tray body 251.

Since the heater accommodation groove 291 is recessed, the heater coupling part 290 may include an inner wall 291*a* and an outer wall 291*b*.

The inner wall 291*a* may have, for example, a ring shape, and the outer wall 291*b* may be disposed to surround the inner wall 291*a*.

When the lower heater 296 is accommodated in the heater accommodation groove 291, the lower heater 296 may surround at least a portion of the inner wall 291*a*.

The lower opening 274 may be defined in a region defined by the inner wall 291*a*. Thus, when the chamber wall 252*d* of the lower tray 250 is accommodated in the chamber accommodation part 272, the chamber wall 252*d* may contact a top surface of the inner wall 291*a*. The top surface of the inner wall 291*a* may be a rounded surface corresponding to the chamber wall 252*d* having the hemispherical shape.

The lower heater may have a diameter greater than a recessed depth of the heater accommodation groove 291 so that a portion of the lower heater 296 protrudes to the outside of the heater accommodation groove 291 in the state in which the lower heater 296 is accommodated in the heater accommodation groove 291.

A separation prevention protrusion 291*c* may be provided on one of the outer wall 291*b* and the inner wall 291*a* to prevent the lower heater 296 accommodated in the heater accommodation groove 291 from being separated from the heater accommodation groove 291.

In FIG. 26, the separation prevention protrusions 291*c* is provided on the inner wall 291*a*.

Since the inner wall 291*a* has a diameter less than that of the chamber accommodation part 272, the lower heater 296 may move along a surface of the chamber accommodation part 272 and then be accommodated in the heater accommodation groove 291 in a process of assembling the lower heater 296.

That is, the lower heater 296 is accommodated in the heater accommodation groove 291 from an upper side of the outer wall 291*b* toward the inner wall 291*a*. Thus, the separation prevention protrusion 291*c* may be disposed on the inner wall 291*a* to prevent the lower heater 296 from interfering with the separation prevention protrusion 291*c* while the lower heater 296 is accommodated in the heater accommodation groove 291.

The separation prevention protrusion 291*c* may protrude from an upper end of the inner wall 291*a* toward the outer wall 291*b*.

A protruding length of the separation prevention protrusion 291*c* may be about ½ of a distance between the outer wall 291*b* and the inner wall 291*a*.

As illustrated in FIG. 27, in the state in which the lower heater 296 is accommodated in the heater accommodation groove 291, the lower heater 296 may be divided into a rounded portion 296*a* and a linear portion 296*b*.

That is, the heater accommodation groove 291 may include a rounded portion and a linear portion. Thus, the lower heater 296 may be divided into the rounded portion 296*a* and the linear portion 296*b* to correspond to the rounded portion and the linear portion of the heater accommodation groove 296.

The rounded portion 296*a* may be a portion disposed along the circumference of the lower chamber 252 and also a portion that is bent to be rounded in a horizontal direction.

The linear portion 296*b* may be a portion connecting the rounded portions 296*a* corresponding to the lower chambers 252 to each other.

Since the rounded portion 296*a* of the lower heater 296 may be separated from the heater accommodation groove 291, the separation prevention protrusion 291*c* may be disposed to contact the rounded portion 296*a*.

A through-opening 291*d* may be defined in a bottom surface of the heater accommodation groove 291. When the lower heater 296 is accommodated in the heater accommodation groove 291, a portion of the upper heater 296 may be disposed in the through-opening 291*d*. For example, the through-opening 291*d* may be defined in a portion of the lower heater 296 facing the separation prevention protrusion 291*c*.

When the lower heater 296 is bent to be horizontally rounded, tension of the lower heater 296 may increase to cause disconnection, and also, the lower heater 296 may be separated from the heater accommodation groove 291.

However, when the through-opening 291*d* is defined in the heater accommodation groove 291 like this embodiment, a portion of the lower heater 296 may be disposed in the through-opening 291*d* to reduce the tension of the lower heater 296, thereby preventing the heater accommodation groove 291 from being separated from the lower heater 296.

The lower support 270 may include a first guide groove 293 guiding a power input terminal 296*c* and a power output terminal of the lower heater 296 accommodated in the heater accommodation groove 291 and a second guide groove 294 extending in a direction crossing the first guide groove 293.

For example, the first guide groove 293 may extend in a direction of an arrow B in the heater accommodation part 291.

Also, the second guide groove 294 may extend from an end of the first guide groove 293 in a direction of an arrow A. In this embodiment, the direction of the arrow A may be a direction that is parallel to the extension direction of a rotational central axis C1 of the lower assembly.

Referring to FIG. 27, the first guide groove 293 may extend from one of the left and right chamber accommodation parts except for the intermediate chamber accommodation part of the three chamber accommodation parts.

For example, in FIG. 27, the first guide groove 293 extends from the chamber accommodation part, which is disposed at the left side, of the three chamber accommodation parts.

As illustrated in FIG. 27, in a state in which the power input terminal 296*c* and the power output terminal 296*d* of the lower heater 296 are disposed in parallel to each other, the lower heater 296 may be accommodated in the first guide groove 293.

The power input terminal 296*c* and the power output terminal 296*c* of the lower heater 296 may be connected to one first connector 297*a*.

Also, a second connector 297*b* to which two wires 298 connected to correspond to the power input terminal 296*c* and the power output terminal 296*d* are connected may be connected to the first connector 297*a*.

In this embodiment, in the state in which the first connector 297*a* and the second connector 297*b* are connected to each other, the first connector 297*a* and the second connector 297*b* are accommodated in the second guide groove 294.

Also, the wire 298 connected to the second connector 297*b* is led out from the end of the second guide groove 294 to the outside of the lower support 270 through an lead-out slot 295 defined in the lower support 270.

According to this embodiment, since the first connector 297*a* and the second connector 297*b* are accommodated in the second guide groove 294, the first connector 297*a* and the second connector 297*b* are not exposed to the outside when the lower assembly 200 is completely assembled.

As described above, the first connector 297*a* and the second connector 297*b* may not be exposed to the outside to prevent the first connector 297*a* and the second connector 297*b* from interfering with the surrounding structure while the lower assembly 200 rotates and prevent the first connector 297*a* and the second connector 297*b* from being separated.

Also, since the first connector 297*a* and the second connector 297*b* are accommodated in the second guide groove 294, one portion of the wire 298 may be disposed in the second guide groove 294, and the other portion may be disposed outside the lower support 270 by the lead-out slot 295.

Here, since the second guide groove 294 extends in a direction parallel to the rotational central axis C1 of the lower assembly 200, one portion of the wire 298 may extend in the direction parallel to the rotational central axis C1.

Also, the other part of the wire 298 may extend from the outside of the lower support 270 in a direction crossing the rotational central axis C1.

According to the arrangement of the wires 298, tensile force may not merely act on the wires 298, but torsion force may act on the wires 298 during the rotation of the lower assembly 200.

When compared that the tensile force acts on the wire 298, if the torsion acts on the wire 298, possibility of disconnection of the wire 298 may be very little.

According to this embodiment, while the lower assembly 200 rotates, the lower heater 296 may be maintained at a fixed position, and twisting force may act on the wire 298 to prevent the lower heater 296 from being damaged and disconnected.

A separation prevention protrusion 293*a* for preventing the accommodated lower heater 296 or wire 298 from being separated may be provided on at least one of the first guide groove 293 and the second guide groove 294.

The power input terminal 296*c* and the power output terminal 296*d* of the lower heater 296 are disposed in the first guide groove 293. Here, since heat is also generated in the power input terminal 296*c* and the power output terminal 296*d*, heat provided to the left chamber accommodation part to which the first guide groove 293 extends may be greater than that provided to other chamber accommodation parts.

In this case, if intensities of the heat provided to each chamber accommodating part are different, transparency of the made spherical ice after the ice making process and the ice separating process may be changed for each ice.

Thus, a detour accommodation groove 292 may be further provided in the chamber accommodation part (for example, the right chamber accommodation part), which is disposed farthest from the first guide groove 292, of the three chamber accommodation parts to minimize a difference in transparency for each ice.

For example, the detour accommodation groove 292 may extend outward from the heater accommodation groove 291 and then be bent so as to be disposed in a shape that is connected to the heater accommodation groove 291.

When the lower heater 296 is additionally accommodated in the detour accommodation groove 292, a contact area between the chamber wall accommodated in the right chamber accommodation part 272 and the lower heater 296 may increase.

Thus, a protrusion 292*a* for fixing a position of the lower heater accommodated in the detour accommodation groove 292 may be additionally provided in the right chamber accommodation part 272.

Referring to FIG. 28, in the state in which the lower assembly 200 is coupled to the upper case 120 of the upper assembly 110, the wire 298 led out to the outside of the lower support 270 may pass through a wire through-slot 138 defined in the upper case 120 to extend upward from the upper case 120.

A restriction guide 139 for restricting the movement of the wire 298 passing through the wire through-slot 138 may be provided in the wire through-slot 138. The restriction guide 139 may have a shape that is bent several times, and the wire 298 may be disposed in a region defined by the restriction guide 139.

Figure 29:
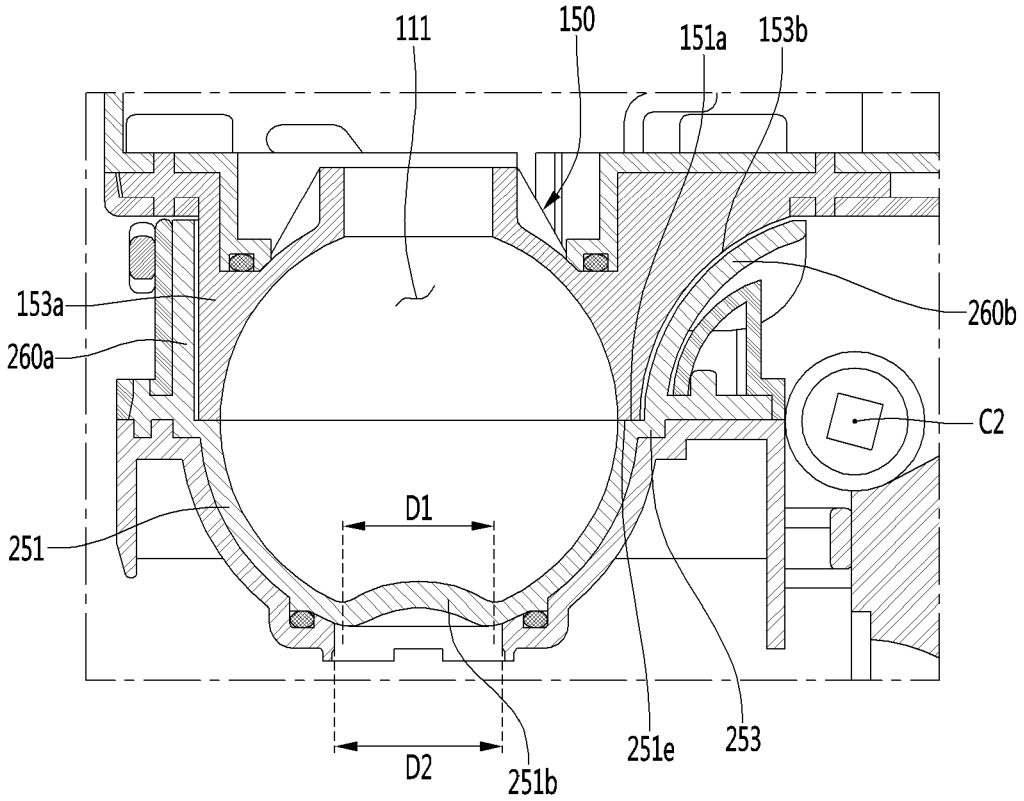
FIG. 29 is a cross-sectional view taken along line A-A of FIG. 3A.
Figure 30:
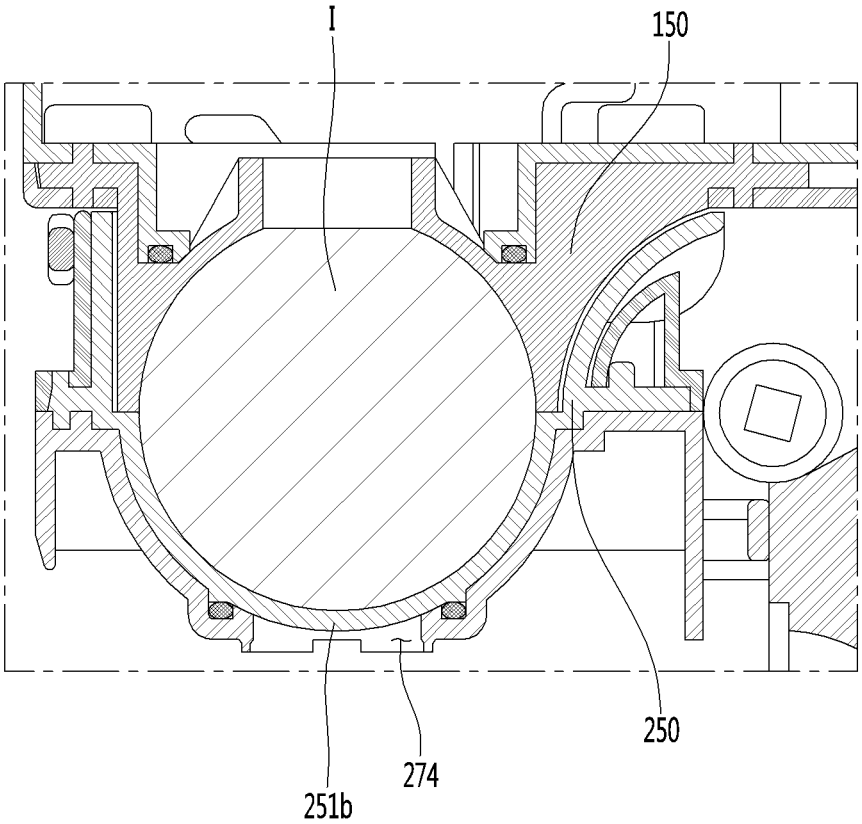
FIG. 30 is a view illustrating a state in which ice is completely made in FIG. 29.

FIG. 29 is a cross-sectional view taken along line A-A of FIG. 3A, and FIG. 30 is a view illustrating a state in which ice is completely made in FIG. 29.

In FIG. 29, a state in which the upper tray and the lower tray contact each other is illustrated.

Referring to FIG. 29, the upper tray 150 and the lower tray 250 vertically contact each other to complete the ice chamber 111.

The bottom surface 151*a* of the upper tray body 151 contacts the top surface 251*e* of the lower tray body 251.

Here, in the state in which the top surface 251*e* of the lower tray body 251 contacts the bottom surface 151*a* of the upper tray body 151, elastic force of the elastic member 360 is applied to the lower support 270.

The elastic force of the elastic member 360 may be applied to the lower tray 250 by the lower support 270, and thus, the top surface 251*e* of the lower tray body 251 may press the bottom surface 151*a* of the upper tray body 151.

Thus, in the state in which the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surface may not occur to prevent ice having a thin band shape along a circumference of the spherical ice from being made after the ice making is completed.

The first extension part 253 of the lower tray 250 is seated on the top surface 271*a* of the support body 271 of the lower support 270. Also, the second extension wall 286 of the lower support 270 contacts a side surface of the first extension part 253 of the lower tray 250.

The second extension part 254 of the lower tray 250 may be seated on the second extension wall 286 of the lower support 270.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250.

Here, the vertical wall 153*a* of the upper tray body 151 may be disposed to face the vertical wall 260*a* of the lower tray 250, and the curved wall 153*b* of the upper tray body 151 may be disposed to face the curved wall 260*b* of the lower tray 250.

An outer surface of the chamber wall 153 of the upper tray body 151 is spaced apart from an inner surface of the circumferential wall 260 of the lower tray 250. That is, a space may be defined between the outer surface of the chamber wall 153 of the upper tray body 151 and the inner surface of the circumferential wall 260 of the lower tray 250.

Water supplied through the water supply part 190 is accommodated in the ice chamber 111. When a relatively large amount of water than a volume of the ice chamber 111 is supplied, water that is not accommodated in the ice chamber 111 may flow into the space between the outer surface of the chamber wall 153 of the upper tray body 151 and the inner surface of the circumferential wall 260 of the lower tray 250.

Thus, according to this embodiment, even though a relatively large amount of water than the volume of the ice chamber 111 is supplied, the water may be prevented from overflowing from the ice maker 100.

In the state in which the top surface 251*e* of the lower tray body 251 contacts the bottom surface 151*a* of the upper tray body 151, the top surface of the circumferential wall 260 may be disposed higher than the upper opening 14 of the upper tray 150 or the upper chamber 152.

A heater contact part 251*a* for allowing the contact area with the lower heater 296 to increase may be further provided on the lower tray body 251.

The heater contact part 251*a* may protrude from the bottom surface of the lower tray body 251. For example, the heater contact part 251*a* may be provided in a ring shape on the bottom surface of the lower tray body 251. Also, the heater contact part 251*a* may have a flat bottom surface.

Although not limited, in the state in which the lower heater 296 contacts the heater contact part 251*a*, the lower heater 296 may be disposed lower than an intermediate point of a height of the lower chamber 252.

The lower tray body 251 may further include a convex part 251*b* in which a portion of the lower portion of the lower tray body 251 is convex upward. That is, the convex part 251*b* may be convexly disposed toward the inside of the ice chamber 111.

A recess part 251*c* may be defined below the convex part 251*b* so that the convex part 251*b* has substantially the same thickness as the other portion of the lower tray body 251.

In this specification, the "substantially the same" is a concept that includes completely the same shape and a shape that is not similar but there is little difference.

The convex part 251*b* may be disposed to vertically face the lower opening 274 of the lower support 270.

Also, the lower opening 274 may be defined just below the lower chamber 252. That is, the lower opening 274 may be defined just below the convex part 251*b*.

The convex part 251*b* may have a diameter D less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex part 251*b* may be disposed on the lower tray body 251 in consideration of the deformation of the lower tray body 251 so that the ice has the completely spherical shape.

In case of this embodiment, the water supplied to the ice chamber 111 may not have a spherical shape before the ice is made. However, after the ice is completely made, the convex part 251*b* of the lower tray body 251 may move toward the lower opening 274, and thus, the spherical ice may be made.

In this embodiment, the convex part 251*b* may have a diameter D1 less than that D2 of the lower opening 274. Thus, the convex part 251*b* may be deformed and positioned inside the lower opening 274.

Hereinafter, a process of making ice by using the ice maker according to an embodiment will be described.

Figure 31:
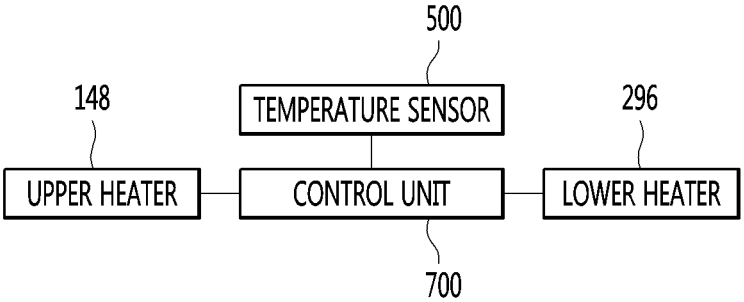
FIG. 31 is a block diagram of the refrigerator according to an embodiment.
Figure 32:
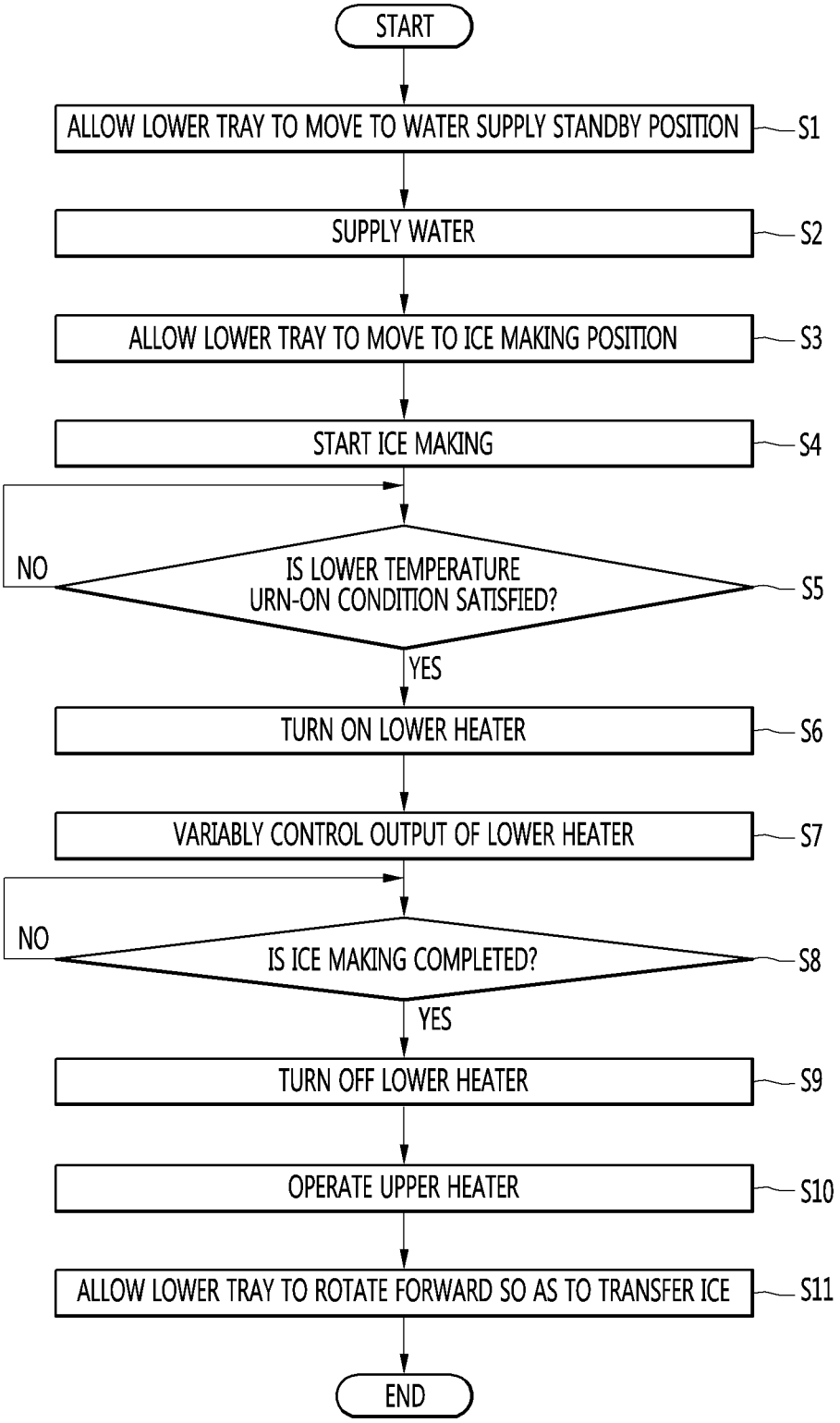
FIG. 32 is a flowchart for explaining a process of making ice in an ice maker according to an embodiment.

FIG. 31 is a block diagram of the refrigerator according to an embodiment. FIG. 32 is a flowchart for explaining a process of making ice in the ice maker according to an embodiment.

Figure 33:
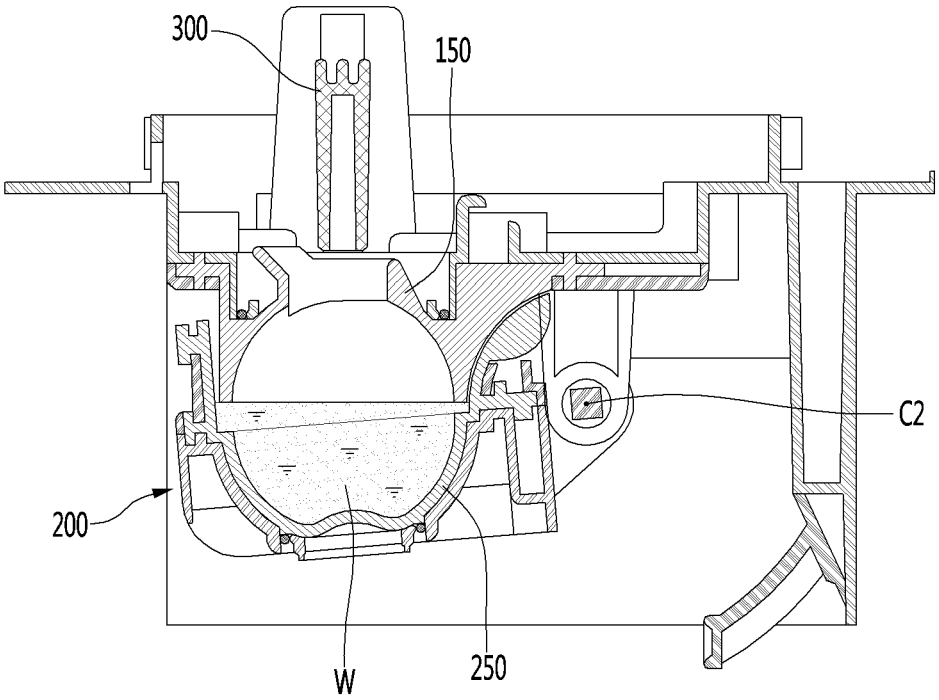
FIG. 33 is a cross-sectional view taken along line B-B of FIG. 3A in a water supply state.
Figure 34:
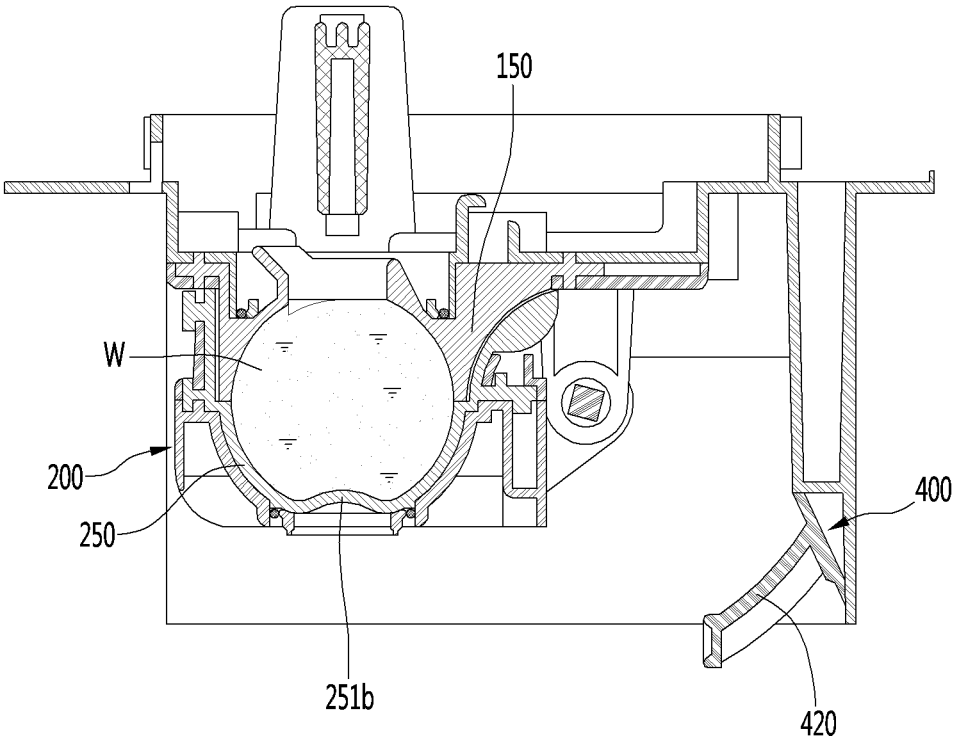
FIG. 34 is a cross-sectional view taken along line B-B of FIG. 3A in an ice making state.

FIG. 33 is a cross-sectional view taken along line B-B of FIG. 3A in a water supply state, and FIG. 34 is a cross-sectional view taken along line B-B of FIG. 3A in an ice making state.

Figure 35:
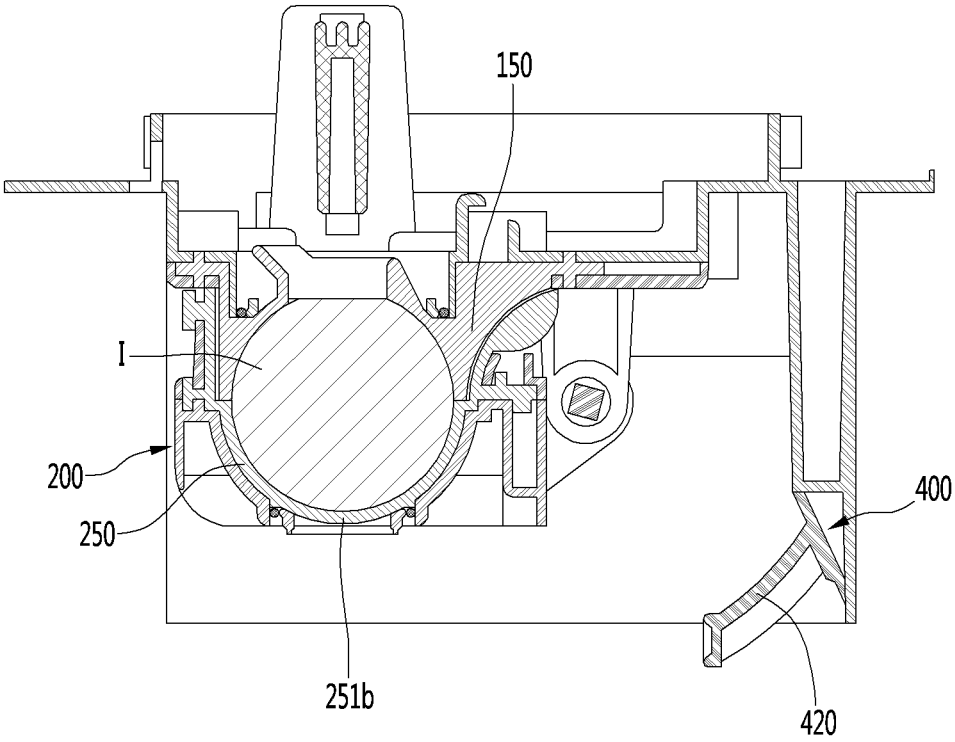
FIG. 35 is a cross-sectional view taken along line B-B of FIG. 3A in a state in which ice is completely made.
Figure 36:
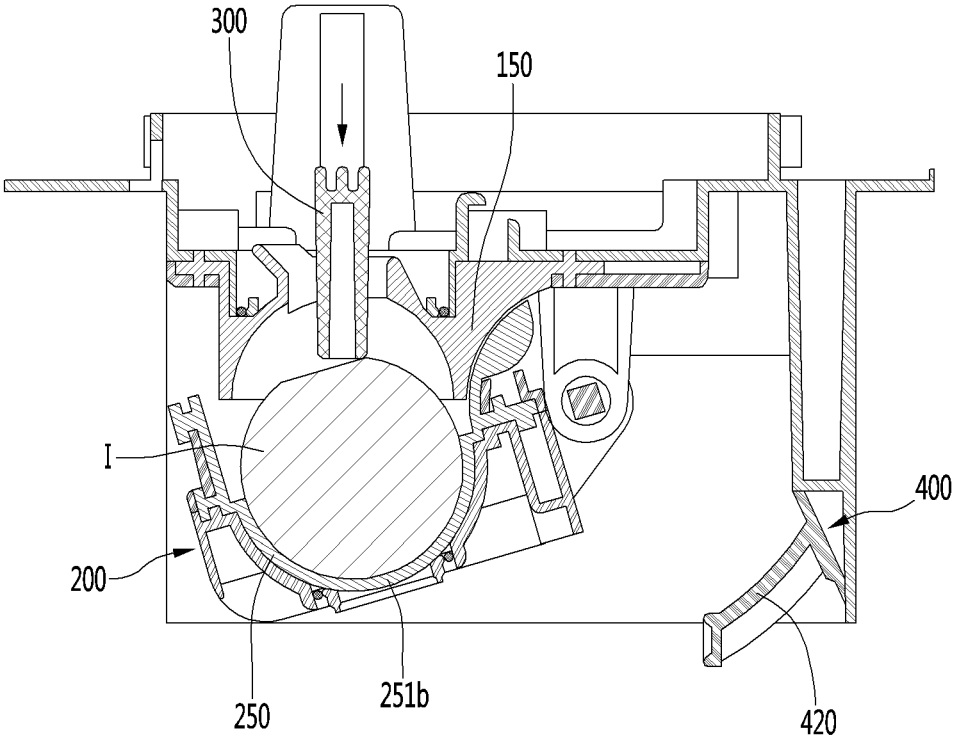
FIG. 36 is a cross-sectional view taken along line B-B of FIG. 3A in an initial ice transfer state.
Figure 37:
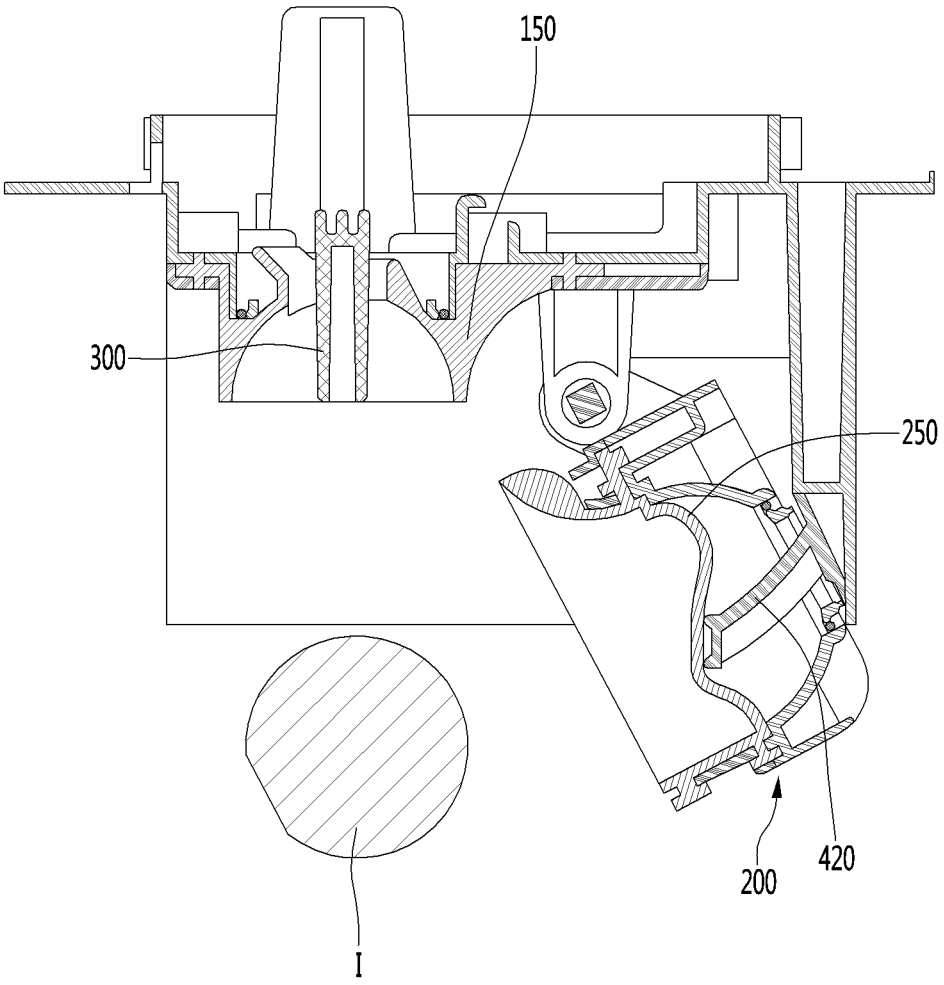
FIG. 37 is a cross-sectional view taken along line B-B of FIG. 3A in a state in which ice is completely transferred.

FIG. 35 is a cross-sectional view taken along line B-B of FIG. 3A in a state in which ice is completely made, FIG. 36 is a cross-sectional view taken along line B-B of FIG. 3A in an initial ice transfer state, and FIG. 37 is a cross-sectional view taken along line B-B of FIG. 3A in a state in which ice is completely transferred.

Referring to FIGS. 31 to 37, the refrigerator according to this embodiment may further include a control unit 700 controlling the upper heater 148 and the lower heater 296.

The control unit 700 may adjust an output of the lower heater 296 during the ice making process.

A specific process of adjusting the output of the lower heater 296 will be described with reference to the accompanying drawings.

To make ice in the ice maker 100, first, the lower assembly 200 moves to a water supply standby position (S1).

For example, in the state in which the lower assembly 200 moves to an ice transfer completion position that will be described later, the control unit 700 may control the driving unit 180 to allow the lower assembly 200 to rotate reversely.

The top surface 251*e* of the lower tray 250 is spaced apart from the bottom surface 151*e* of the upper tray 150 at the water supply standby position of the lower assembly 200.

Although not limited, the bottom surface 151*e* of the upper tray 150 may be disposed at a height that is equal or similar to a rotational center C2 of the lower assembly 200.

In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply standby position of the lower assembly 200 may be about 8 degrees.

In this state, supply of water is started (S2). For example, water flows to the water supply part 190 through a water supply tube connected to an external water supply source or a water tank of the refrigerator 1. Thus, the water is guided by the water supply part 190 and supplied to the ice chamber 111.

Here, the water is supplied to the ice chamber 111 through one upper opening of the plurality of upper openings 154 of the upper tray 150.

In the state in which the supply of the water is completed, a portion of the supplied water may be fully filled into the lower chamber 252, and the other portion of the supplied water may be fully filled into the space between the upper tray 150 and the lower tray 250.

For example, the upper chamber 151 may have the same volume as that of the space between the upper tray 150 and the lower tray 250. Thus, the water between the upper tray 150 and the lower tray 250 may be fully filled in the upper tray 150.

In case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

Also, in the case of this embodiment, since the channel for the communication between the lower chambers 252 is not provided in the lower tray 250, additional ice having a projection shape around the ice after the ice making process may be prevented being made.

In the state in which the supply of the water is completed, the lower assembly 200 moves to its original position.

For example, as illustrated in FIG. 34, the control unit 700 may control the driving unit 180 to allow the lower assembly 200 to rotate reversely.

When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

Also, when the top surface 251*e* of the lower tray 250 and the bottom surface 151*e* of the upper tray 150 are closely attached to each other, the water may be fully filled in the upper chamber 152.

In the state in which the top surface 251*e* of the lower tray 250 and the bottom surface 151*e* of the upper tray 150 are closely attached to each other, a position of the lower assembly 200 may be called an ice making position.

In the state in which the lower assembly 200 moves to the ice making position, ice making is started (S4).

Since pressing force of water (or the expansive force of water) during ice making is less than the force for deforming the convex part 251*b* of the lower tray 250, the convex part 251*b* may not be deformed to maintain its original shape.

After the ice making is started, the control unit 700 determines whether a turn-on condition of the lower heater 296 is satisfied (S5).

That is, in the case of this embodiment, the lower heater 296 may not turned on only when the turn-on condition of the lower heater 296 is satisfied, but the lower heater 296 is not turned on immediately after the ice making is started.

Particularly, generally, the water supplied to the ice chamber 111 may be water at normal temperature or water at a temperature lower than normal temperature. The temperature of the water supplied is higher than the freezing point of water.

Thus, after the water supply, the temperature of the water is lowered by the cold air, and when the temperature of the water reaches the freezing point of the water, the water is changed into ice.

In the case of this embodiment, the lower heater 296 is not turned on until the water is phase-changed into ice. If the lower heater 296 is turned on before reaching the freezing point of the water in the ice chamber 111, a rate at which the temperature of the water reaches the freezing point is lowered by the heat of the lower heater 296, resulting in reducing an ice making rate. That is, the lower heater is unnecessarily operated regardless of the transparency of the ice.

Thus, according to this embodiment, when the turn-on condition of the lower heater 296 is satisfied, the lower heater 296 is turned on to prevent power consumption due to unnecessary operation of the lower heater 296.

In this embodiment, the control unit 700 determines that the turn-on condition of the lower heater 296 is satisfied when a temperature detected by the temperature sensor 500 reaches a turn-on reference temperature.

For example, the turn-on reference temperature is a temperature for determining that freezing of water is started at the uppermost side (an upper opening side) of the ice chamber 111.

In this embodiment, since the ice chamber 111 is blocked by the upper tray 150 and the lower tray 250 except for the upper opening 154, the water in the ice chamber 111 may directly contact the cold air through the upper opening 154 to make ice from the uppermost side in which the upper opening is disposed in the ice chamber 111.

When water is frozen in the ice chamber 111, a temperature of the ice in the ice chamber 111 is a below-zero temperature, that is, a temperature less than 0° C.

Also, the temperature of the upper tray 150 is higher than that of the ice in the ice chamber 111.

In the case of this embodiment, the temperature sensor 500 may detect the temperature of the upper tray 150 by contacting the upper tray 150 without directly detecting the temperature of the ice.

According to the above-described arranged structure, to determine that making of ice is started in the ice chamber 111 on the basis of the temperature detected by the temperature sensor 500, the turn-on reference temperature may be set to the below-zero temperature.

That is, when the temperature detected by the temperature sensor 500 reaches the turn-on reference temperature, since the turn-on reference temperature is the below-zero temperature, and the temperature of the ice in the ice chamber 111 is lower than the turn-on reference temperature, it may be indirectly determined that the ice is made in the ice chamber 111.

When the lower heater 296 is turned on, heat of the lower heater 296 is transferred to the lower tray 250.

Thus, when the ice making is performed in the state where the lower heater 296 is turned on, ice may be made from the upper side in the ice chamber 111 because the heat is supplied to the lower chamber 252 through the water contained in the lower chamber 252.

In this embodiment, since ice is made from the upper side in the ice chamber 111, the bubbles in the ice chamber 111 may move downward. Since a density of water is greater than that of ice, the bubbles in the water may easily move downward to be gathered downward.

Since the ice chamber 111 has a spherical shape, the horizontal cross-sectional area for each height of the ice chambers 111 are different from each other.

When it is assumed that the same amount of cold air is supplied to the ice chamber 111, if the output of the lower heater 296 is the same, the horizontal cross-sectional area for each height of the ice chambers 111 may be different from each other, and thus, ice may be made at heights different from each other. That is to say, the height, at which ice is made, per unit time may be non-uniform.

In this case, the bubbles in the water may not move downward and be contained in the ice so that the ice becomes opaque.

Thus, according to this embodiment, the control unit 700 controls the output of the lower heater 296 according to the height of the ice made in the ice chamber 111 (S7).

The horizontal cross-sectional area of the ice increases from the upper side to the lower side and then is maximized at a boundary between the upper tray 150 and the lower tray 250 and decreases again to the lower side. The control unit 700 allows the output of the lower heater 296 to vary in response to a variation in horizontal cross-sectional area according to the height. A variable output control of the lower heater 296 will be described later with reference to the drawings.

While ice is continuously made from the upper side to the lower side in the ice chamber 111, the ice may contact a top surface of a block part 251*b* of the lower tray 250.

In this state, when the ice is continuously made, the block part 251*b* may be pressed and deformed as shown in FIG. 35, and the spherical ice may be made when the ice making is completed.

The control unit 700 may determine whether the ice making is completed based on the temperature sensed by the temperature sensor 500.

When it is determined that the ice making is completed, the control unit 700 may turn off the lower heater 296 (S9).

In the case of this embodiment, the distance between the temperature sensor 500 and each of the ice chambers 111 may be different from each other. Thus, to determine that the making of ice is completed in all the ice chambers 111, ice transfer may be started after a certain time elapses from a time point at which it is determined that the ice making is completed.

When the ice making is completed, to transfer the ice, the control unit 700 may operate the upper heater 148 (S10).

When the upper heater 148 is turned on, the heat of the upper heater 148 is transferred to the upper tray 150, and thus, the ice may be separated from the surface (the inner surface) of the upper tray 150.

Also, the heat of the upper heater 148 may be transferred to the contact surface between the upper tray 150 and the lower tray 250 to separate the bottom surface 151*a* of the upper tray 150 and the top surface 251*e* of the lower tray 250 from each other.

When the upper heater 148 is operated for a set time, the control unit 700 may turn of the upper heater 148. Also, the driving unit 180 is operated so that the lower assembly 200 rotate forward (S11).

As illustrated in FIG. 36, when the lower assembly 200 rotates forward, the lower tray 250 may be spaced apart from the upper tray 150.

Also, the rotation force of the lower assembly 200 may be transmitted to the upper ejector 300 by the connection unit 350. Thus, the upper ejector 300 descends by the unit guides 181 and 182, and the upper ejecting pin 320 may be inserted into the upper chamber 152 through the upper opening 154.

In the ice separating process, the ice may be separated from the upper tray 250 before the upper ejecting pin 320 presses the ice. That is, the ice may be separated from the surface of the upper tray 150 by the heat of the upper heater 148.

In this case, the ice may rotate together with the lower assembly 200 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state in which the ice is closely attached to the upper tray 150.

In this state, while the lower assembly 200 rotates, the upper ejecting pin 320 passing through the upper opening 154 may press the ice closely attached to the upper tray 150 to separate the ice from the upper tray 150. The ice separated from the upper tray 150 may be supported again by the lower tray 250.

When the ice rotates together with the lower assembly 200 in the state in which the ice is supported by the lower tray 250, even though external force is not applied to the lower tray 250, the ice may be separated from the lower tray 250 by the self-weight thereof.

While the lower assembly 200 rotates, even though the ice is not separated from the lower tray 250 by the self-weight thereof, when the lower tray 250 is pressed by the lower ejector 400, the ice may be separated from the lower tray 250.

Particularly, while the lower assembly 200 rotates, the lower tray 250 may contact the lower ejecting pin 420.

Also, when the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250.

The ice separated from the surface of the lower tray 250 may drop downward and be stored in the ice bin 102.

After the ice is separated from the lower tray 250, the control unit 700 controls the driving unit 180 so that the lower assembly 200 rotates reversely.

When the lower ejecting pin 420 is spaced apart from the lower tray 250 while the lower assembly 200 rotates reversely, the lower tray 250 may be restored to its original shape.

Also, while the lower assembly 200 rotates reversely, the rotation force may be transmitted to the upper ejector 300 by the connection unit 350, and thus, the upper ejector 300 may ascend, and the upper ejecting pin 320 may be separated from the upper chamber 152.

Also, when the lower assembly 200 reaches the water supply standby position, the driving unit 180 may be stopped, and the water supply may be started again.

Figure 38A:
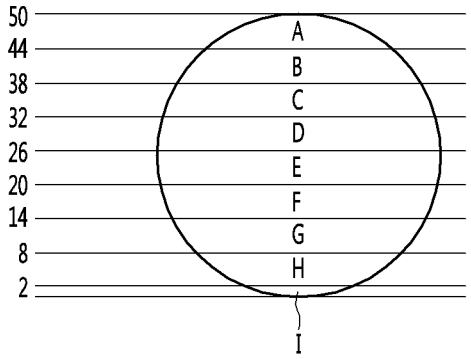
FIGS. 38A and 38B are illustrative views explaining an output of the lower heater for each height of the ice made in the ice chambers.
Figure 38B:
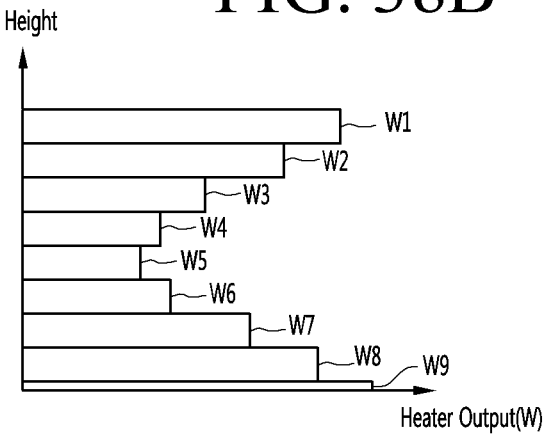

FIGS. 38A and 38B are views explaining an output of the lower heater for each height of the ice made in the ice chambers. FIG. 38A illustrates a state in which the spherical ice chamber is divided into a plurality of sections by heights, and FIG. 38B illustrates an output of the lower heater for each height section of the ice chamber.

In this embodiment, for example, the spherical ice chamber (or a diameter of the ice) having a diameter of about 50 mm is divided into nine sections (sections A to I) at an interval of about 6 mm (a reference interval), and it should be noted that the diameter of the ice chamber (or the diameter of the ice) and the number of divided sections are not limited.

Figure 39:
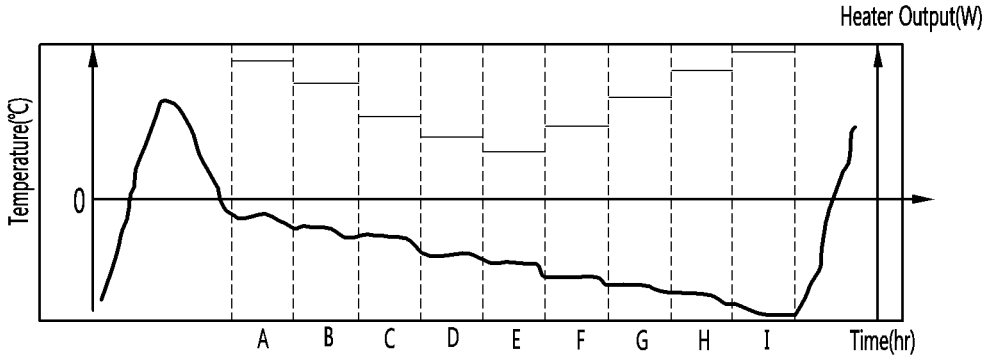
FIG. 39 is a graph illustrating a temperature detected by a temperature sensor and an output of the lower heater in water supply and ice making processes.
Figure 40:
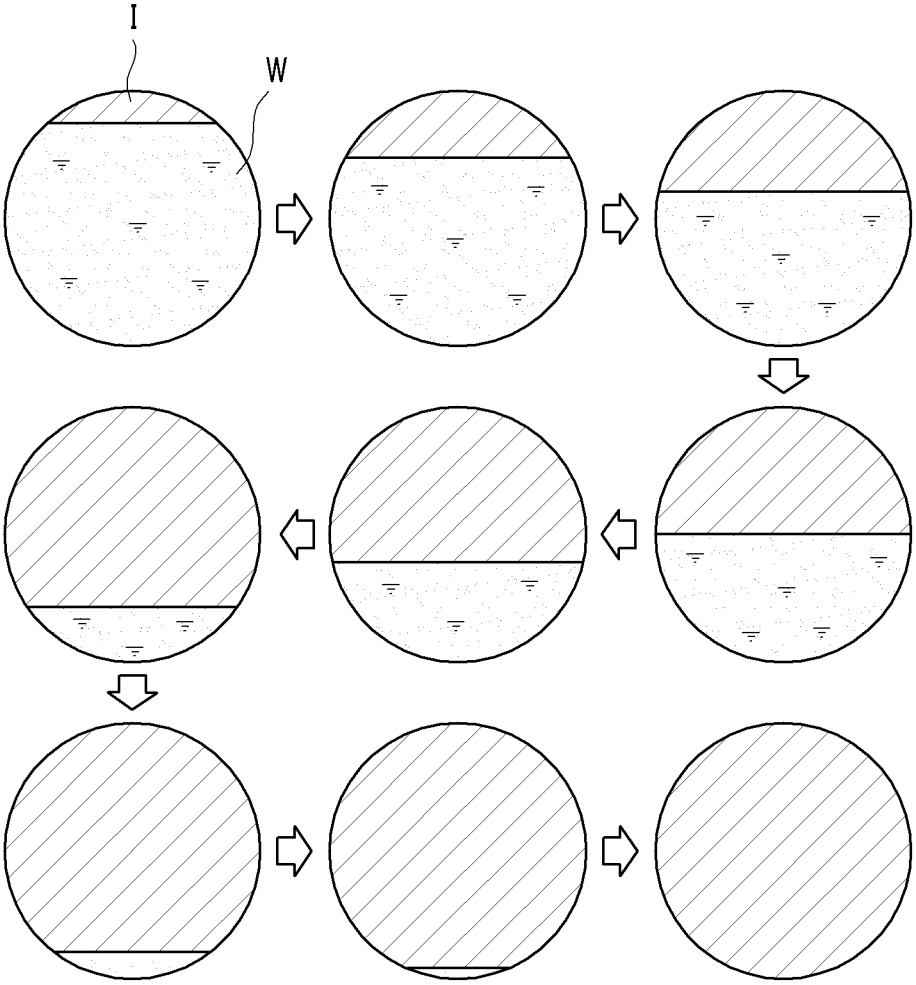
FIG. 40 is a view sequentially illustrating a process of making ice for each height section of ice.

FIG. 39 is a graph illustrating a temperature detected by the temperature sensor and an output of the lower heater in the water supply and ice making processes, and FIG. 40 is a view sequentially illustrating a process of making ice for each height section of ice.

FIG. 40, reference symbol I represents made ice, and reference symbol W represents water.

Referring to FIGS. 38 and 39, when the ice chamber is divided into the reference intervals, the heights of the sections A to H are the same, and the height of the section I is less than that of each of the remaining sections. Alternatively, all the divided sections may be the same height according to the diameter of the ice chamber (or the diameter of the ice) and the number of divided sections.

Since the section E is a section including a maximum horizontal diameter of the ice chamber, the section E may have a maximum volume and a volume that gradually decreases from the section E toward the upper section and the lower section.

As described above, when it is assumed that the same cold air amount is supplied, and the output of the lower heater 296 is constant, the ice making rate in the section E is the slowest, and the ice making rate in the section A and the section I is the fastest.

In this case, the ice making rate may vary according to each section, and transparency of the ice may vary according to the sections. In a specific section, the ice making rate may be too fast to contain bubbles.

In this embodiment, the lower heater 296 may be controlled so that the bubbles in the water move downward while the ice is made, and the rate at which the ice is made is the same or similar to each other.

Particularly, since a volume of the section E is the largest, an output W5 of the lower heater 296 in the section E may be set to a maximum low value.

Also, since a volume of the section D is less than that of the section E, a volume of the ice may be reduced as the volume decreases, and it is necessary to delay the ice making rate.

Thus, an output W6 of the lower heater 296 in the section D may be set to a value greater than the output W5 of the lower heater 296 in the section E.

Since a volume in the section C is less than that in the section D by the same reason, an output W3 of the lower heater 296 in the section C may be set to a value greater than the output W4 of the lower heater 296 in the section D.

Also, since a volume in the section B is less than that in the section C, an output W2 of the lower heater 296 in the section B may be set to a value greater than the output W3 of the lower heater 296 in the section C.

Also, since a volume in the section A is less than that in the section B, an output W1 of the lower heater 296 in the section A may be set to a value greater than the output W2 of the lower heater 296 in the section B.

Since a volume in the section F is less than that in the section E by the same reason, an output W6 of the lower heater 296 in the section F may be set to a value greater than the output W5 of the lower heater 296 in the section E.

Also, since a volume in the section G is less than that in the section F, an output W7 of the lower heater 296 in the section G may be set to a value greater than the output W6 of the lower heater 296 in the section F.

Also, since a volume in the section H is less than that in the section G, an output W8 of the lower heater 296 in the section H may be set to a value greater than the output W7 of the lower heater 296 in the section G.

Also, since a volume in the section I is less than that in the section H, an output W9 of the lower heater 296 in the section I may be set to a value greater than the output W8 of the lower heater 296 in the section H.

Thus, according to an output variation pattern of the lower heater 296, the output of the lower heater 296 is gradually reduced from the first section to the intermediate section after the lower heater 296 is initially turned on.

Also, the output of the lower heater 296 is minimized in the intermediate section of the ice chamber 111 (the section having the maximum horizontal diameter).

Also, the output of the lower heater 296 increases in stages from the next section of the intermediate section of the ice chamber 111.

Referring to FIG. 39, as the height of the made ice increases, the temperature detected by the temperature sensor 500 decreases. Also, the section reference temperature for each section may be predetermined and stored in a memory.

Thus, when the temperature detected by the temperature sensor 500 reaches the reference temperature of the next section in the present section, the control unit 700 allows an output of the lower heater 296 corresponding to the present section to vary to an output of the lower heater corresponding to the next section.

In FIG. 38A, it is assumed that the convex part 251*b* does not exist in the lower tray 250 for easy understanding.

In the case of this embodiment, since the convex part 251*b* is provided in the lower tray 250, the section I may not exist depending on the number of sections in the ice chamber 111. Alternatively, the section I may correspond to a section in which the block part 252*b* is located.

In any case, the section including the block part 252*b* may correspond to the final section of the plurality of sections, and the output of the lower heater 296 may be determined based on the volume of the section.

Since the lower heater 296 is controlled in output, the transparency of the ice may be uniform for each section, and the bubbles may be gathered in the lowermost section so that the bubbles are collected locally in the entire ice, and the remaining portions are made to be entirely transparent.

By the proposed invention, since the ice is generated from the upper side as the lower heater is operated in the ice making process, the bubbles moves toward the lower side, and since the bubbles are finally present in the lowermost local section of the ice, there is an advantage that a spherical ice is generally transparent.

In addition, in the case of the present invention, since the output of the lower heater varies according to height sections of the ice (or the ice chamber), a generation speed of ice according to the height sections of the ice gets uniform, and accordingly, there is an advantage that transparency gets uniform according to the heights of the ice.

In addition, since the heat of the lower heater can be evenly provided to a plurality of ice chambers, there is an advantage that transparency is uniform according to the generated ice.

What is claimed is:

1. An ice maker comprising:

a tray body that comprises a plurality of chamber walls that are configured to define a plurality of ice chambers;

a first heater configured to supply heat to the plurality of ice chambers during an ice-making process;

a second heater configured to supply heat to the plurality of ice chambers during an ice-separation process;

a water supply configured to supply water to the plurality of ice chambers;

a temperature sensor configured to sense a temperature of at least one of the plurality of ice chambers; and a controller configured to control the first heater and the second heater, wherein the controller is configured to:

control the first heater to output one or more levels of power to thereby heat the plurality of ice chambers during the ice-making process according to the temperature sensed by the temperature sensor, control the first heater to vary the one or more levels of power during the ice-making process according to the temperature sensed by the temperature sensor, control the first heater to stop outputting the one or more levels of power during a predetermined time period, and control the second heater to start the ice-separating process after the predetermined time period.

2. An ice maker comprising:

a tray body that comprises a plurality of chamber walls that are configured to define a plurality of ice chambers;

a first heater configured to supply heat to the plurality of ice chambers during an ice-making process;

a second heater configured to supply heat to the plurality of ice chambers during an ice-separation process;

a water supply configured to supply water to the plurality of ice chambers;

a temperature sensor configured to sense a temperature of at least one of the plurality of ice chambers; and a controller configured to control the first heater and the second heater, wherein the controller is configured to:

control the first heater to output one or more levels of power to thereby heat the plurality of ice chambers during the ice-making process according to the temperature sensed by the temperature sensor, based on controlling the first heater during the ice-making process, define an ice forming direction in an ice chamber among the plurality of ice chambers, define a plurality of ice levels to be formed in the ice chamber along the ice forming direction, set the one or more levels of power based on the plurality of ice levels, control the first heater to stop outputting the one or more levels of power during a predetermined time period, and control the second heater to start the ice-separating process after the predetermined time period.

3. The ice maker of claim 2, wherein the controller is configured to:

set a target temperature corresponding to each of the plurality of ice levels;

set a target output of the first heater corresponding to each of the plurality of ice levels;

during the ice-making process, compare the temperature sensed by the temperature sensor to the target temperature; and control the first heater to output the target output based on the temperature sensed by the temperature sensor reaching the target temperature.

4. An ice maker comprising:

a tray body that comprises a plurality of chamber walls that are configured to define a plurality of ice chambers;

a first heater configured to supply heat to the plurality of ice chambers during an ice-making process;

a second heater configured to supply heat to the plurality of ice chambers during an ice-separation process;

a water supply configured to supply water to the plurality of ice chambers;

a temperature sensor configured to sense a temperature of at least one of the plurality of ice chambers; and a controller configured to control the first heater and the second heater, wherein the controller is configured to:

control the first heater to output one or more levels of power to thereby heat the plurality of ice chambers during the ice-making process according to the temperature sensed by the temperature sensor, controlling the first heater to output the one or more levels of power comprising:

controlling the first heater to output a first power level for a first time period, controlling the first heater to output a second power level different from the first power level for a second time period after the first time period, and controlling the first heater to output a third power level different from the first and second power levels for a third time period after the second time period, control the first heater to stop outputting the one or more levels of power during a fourth time period, and control the second heater to start the ice-separating process after the fourth time period.

5. The ice maker of claim 4, wherein the controller is configured to turn off the first heater during the fourth time period between the ice-making process and the ice-separation process.

6. The ice maker of claim 4, wherein the controller is configured to, during the ice-making process, control the first heater to increase an output power level and then decrease the output power level.

7. The ice maker of claim 4, wherein the controller is configured to control the first heater to output the one or more levels of power based on the temperature sensed by the temperature sensor reaching a target temperature after water is supplied to the plurality of ice chambers.

8. The ice maker of claim 4, wherein the controller is configured to control the first heater to output the one or more levels of power based on the temperature sensed by the temperature sensor being less than 0° C.

9. The ice maker of claim 4, wherein the tray body defines a sensor accommodation part that receives the temperature sensor.

10. The ice maker of claim 4, wherein the temperature sensor is disposed between two adjacent chamber walls among the plurality of chamber walls, the temperature sensor being in contact with at least a portion of the two adjacent chamber walls.

11. The ice maker of claim 4, wherein the first heater is in contact with the plurality of chamber walls, and the second heater is spaced apart from the first heater.

12. The ice maker of claim 4, wherein the plurality of chamber walls are arranged along a first direction, and wherein the temperature sensor is disposed at a position offset toward one of the plurality of ice chambers in the first direction with respect to a center chamber among the plurality of ice chambers.

13. The ice maker of claim 4, wherein a first distance between the temperature sensor and a first chamber wall among the plurality of chamber walls is different from a second distance between the temperature sensor and a second chamber wall among the plurality of chamber walls.

14. The ice maker of claim 4, wherein the plurality of chamber walls are arranged along a first direction, wherein the tray body defines a plurality of openings that are open to the plurality of ice chambers, respectively, and configured to supply water to the plurality of ice chambers, and wherein the second heater is disposed at a position away from the plurality of openings in a second direction orthogonal to the first direction.

15. The ice maker of claim 4, wherein the first heater comprises:

a plurality of contact portions that are in contact with the plurality of chamber walls and have a round shape curved along outer surfaces of the plurality of chamber walls; and a plurality of connection portions that have a linear shape extending between the plurality of contact portions.

16. The ice maker of claim 4, wherein the second heater surrounds the plurality of chamber walls.

17. The ice maker of claim 4, further comprising:

a first tray that defines a first part of the plurality of chamber walls; and a second tray that defines a second part of the plurality of chamber walls, the second tray being configured to move relative to the first tray to thereby open and close the plurality of ice chambers, wherein the first heater is disposed at the first tray or the second tray.

18. The ice maker of claim 4, further comprising a supporter that supports the tray body, the supporter defining:

a plurality of chamber accommodation parts that receive the plurality of chamber walls; and a heater coupling part coupled to the first heater.

19. The ice maker of claim 18, wherein the heater coupling part includes a heater accommodation groove that is recessed from the plurality of chamber accommodation parts in a direction away from the plurality of chamber walls and receives the first heater.

20. The ice maker of claim 19, wherein the heater coupling part comprises an inner wall and an outer wall that define the heater accommodation groove, the outer wall surrounding the heater accommodation groove, and wherein the first heater is accommodated in the heater accommodation groove and surrounds at least a portion of the inner wall.

* * * * *